US010238219B2

(12) United States Patent
Nilles et al.

(10) Patent No.: US 10,238,219 B2
(45) Date of Patent: Mar. 26, 2019

(54) REFRIGERATION CABINET

(71) Applicant: SCHOTT AG, Mainz (DE)

(72) Inventors: Dietmar Nilles, Koenigswinter-Thomasberg (DE); Jochen Diederichs, Mainz (DE); Michael Lammel, Aachen (DE); Bertrand Illert, Aachen (DE); Blazek Lumir, Vsetin (CZ); Jiri Gazda, Zubri (CZ); Petr Divin, Vsetin (CZ)

(73) Assignee: SCHOTT AG, Mainz (DE)

( * ) Notice: Subject to any disclaimer, the term of this patent is extended or adjusted under 35 U.S.C. 154(b) by 477 days.

(21) Appl. No.: 14/321,440

(22) Filed: Jul. 1, 2014

(65) Prior Publication Data

US 2014/0311173 A1 Oct. 23, 2014

Related U.S. Application Data

(63) Continuation of application No. PCT/EP2013/052950, filed on Feb. 14, 2013.

(30) Foreign Application Priority Data

Feb. 16, 2012 (DE) ..... 10 2012 202 392

(51) Int. Cl.
*A47F 3/04* (2006.01)
*E05F 15/20* (2006.01)
*F25D 23/02* (2006.01)

(52) U.S. Cl.
CPC ..... *A47F 3/043* (2013.01); *F25D 23/028* (2013.01); *F25D 2323/024* (2013.01); *F25D 2700/02* (2013.01); *F25D 2700/04* (2013.01)

(58) Field of Classification Search
CPC .. A47F 3/043; F25D 23/021; F25D 2323/021; F25D 2323/024; F25D 2700/02; F25D 2700/04

(Continued)

(56) References Cited

U.S. PATENT DOCUMENTS 5,584,189 A * 12/1996 Bustos ..... A47F 3/0408 62/255
6,637,494 B1 10/2003 Nabeta (Continued)

FOREIGN PATENT DOCUMENTS

CN 2737903 11/2005
DE 202005015150 U1 2/2007

(Continued)

OTHER PUBLICATIONS

International Search Report dated Jun. 21, 2013 corresponding to PCT/EP2013/052950 with English translation, 7 pp.

(Continued)

*Primary Examiner* — Steven B McAllister
*Assistant Examiner* — Steven S Anderson, II
(74) *Attorney, Agent, or Firm* — Ohlandt, Greeley, Ruggiero & Perle, L.L.P.

(57) ABSTRACT

A refrigeration cabinet, in particular a commercial refrigerator or freezer, is provided. The refrigeration cabinet has a housing, which has a front access opening, a door, which has at least one door leaf, for the access opening, and a guide. The door leaf has a height and a width and is mounted such that it can be rotated about a vertical rotation axis and can be displaced transverse to the rotation axis. The guide defines a movement of the door leaf between a closed position and an open position in such a way that the pivot region of the door leaf projects less than a full door-leaf width into the exterior in front of the access opening, and that the door leaf is mounted such that it can be rotated about a vertical axis and can be displaced transverse to the rotation axis.

25 Claims, 24 Drawing Sheets

(58) Field of Classification Search
USPC ..... 62/249
See application file for complete search history.

(56) References Cited

U.S. PATENT DOCUMENTS

| | | | | |
|---|---|---|---|---|
| 2001/0030606 | A1* | 10/2001 | Jaffe | F25D 23/021 340/545.6 |
| 2004/0050087 | A1* | 3/2004 | Wasnock | F25D 23/021 62/265 |
| 2005/0217297 | A1* | 10/2005 | Wilson | A47F 3/0443 62/255 |
| 2006/0080994 | A1* | 4/2006 | Seiden | F25D 11/02 62/441 |
| 2006/0199497 | A1* | 9/2006 | Smith | F24F 9/00 454/173 |
| 2008/0195944 | A1* | 8/2008 | Lee | F25D 29/00 715/706 |
| 2009/0021125 | A1 | 1/2009 | Weiss | |
| 2010/0319256 | A1* | 12/2010 | Agam | G01S 15/04 49/31 |
| 2011/0175509 | A1* | 7/2011 | Moeller | A47F 3/043 312/405 |
| 2012/0291471 | A1 | 11/2012 | Giulietti | |

FOREIGN PATENT DOCUMENTS

| | | | | |
|---|---|---|---|---|
| DE | 102007029188 | A1 | 1/2009 | |
| DE | 102007034417 | A1 | 1/2009 | |
| DE | 102009026659 | A1 | 12/2010 | |
| DE | 102011103300 | A1 | 11/2012 | |
| EP | 1754852 | A2 * | 2/2007 | E05D 15/0604 |
| EP | 1930675 | A2 | 6/2008 | |
| EP | 2345347 | A1 | 7/2011 | |
| EP | 2525177 | A1 | 11/2012 | |
| JP | S4896548 | | 11/1973 | |
| JP | S52169038 | | 12/1977 | |
| JP | S5485997 | | 6/1979 | |
| JP | S5494667 | | 7/1979 | |
| JP | S5659178 | | 5/1981 | |
| JP | S5698981 | | 8/1981 | |
| JP | 56133568 | U * | 10/1981 | |
| JP | S56133568 | | 10/1981 | |
| JP | H0367979 | | 3/1991 | |
| JP | 2000356071 | | 12/2000 | |
| JP | 2001059380 | | 3/2001 | |
| JP | 2002285755 | | 10/2002 | |
| JP | 2005345040 | | 12/2005 | |
| KR | 101081617 | | 11/2011 | |
| WO | 9213161 | A1 | 8/1992 | |

OTHER PUBLICATIONS

Written Opinion of the International Searching Authority dated Jun. 21, 2013 corresponding to PCT/EP2013/052950 with English translation, 10 pp.

International Preliminary Report on Patentability dated Aug. 19, 2014 corresponding to PCT/EP2013/052950 with English translation, 13 pp.

* cited by examiner

REFRIGERATION CABINET

CROSS REFERENCE TO RELATED APPLICATIONS

This application is a continuation of International Application No. PCT/EP2013/052950, filed Feb. 14, 2013, which claims benefit under 35 U.S.C. § 119(a) of German Patent Application No. 10 2012 202 392.5, filed Feb. 16, 2012, the entire contents of both of which are incorporated by reference herein.

BACKGROUND OF THE INVENTION

1. Field of the Invention

The invention relates to a refrigeration cabinet, in particular a commercial refrigerator or freezer, having a housing, which has a front access opening, and a door having at least one door panel for the access opening, wherein the door panel has a height and a width.

2. Description of Related Art

Such a refrigeration cabinet is known, for example, from the document EP 2 345 347 A1. Involved therein is a refrigerated cabinet that is open during sales hours, the door being stored by being moved into a parked position laterally in the housing next to the refrigerated space. In this way, the sales-inhibiting effect of a closed door shall be avoided, but at the same time, a door will be available with which the refrigerated space can be closed outside of sales hours in order to be able to save energy costs. It basically involves an open refrigeration cabinet for manipulation during sales hours.

Proceeding therefrom, the inventor aims at further reducing energy costs by also providing a closure for the access opening during sales hours. However, this will be easy to open and thus does not represent an inhibition for sales. In fact, commercial refrigeration cabinets are known, which have ordinary doors that are hinged on one side and thus can be rotated about a vertical axis of rotation. For example, in this respect, refer to the Unexamined Patent Application DE 10 2007 034 417 A1. Of course, such doors not only represent a barrier for goods in the interior space of the refrigeration cabinet, but also a blockage in the external space in front of the refrigeration cabinet when it is open. Usually a sales area is found there where customers move about and stop. The problem is multiplied where several refrigeration cabinets of this type are set up next to one another and for orientation, customers examine the offering of goods for the most part closely by standing for a long time in front of the closed doors. Customers thus additionally prevent access to the goods or vice versa, they are prevented from passing due to opened doors.

A refrigeration cabinet of the type named initially is known from EP 2 525 177 A1, whose doors swing inward upon opening, completely into the refrigerated space or interior space of the refrigeration cabinet defined by the housing, and therefore, a pivoting region is not required in front of the housing. Some of the discussed problems can be solved therewith. Of course, the pivoting region is now moved into the refrigerated space, whereby either the useful refrigerated space is extremely limited and the distance from the front of the refrigeration cabinet to the goods is increased or whereupon, in order to counteract this, the width of the door must be significantly limited. Both of these again form a barrier to the goods.

SUMMARY

Consequently, the object of the present invention is to provide a refrigeration cabinet of the type named initially, which can be opened in a space-saving way, and at the same time conveniently, and thus when the goods are accessed, forms a hindrance that is as small as possible for this access and for the surrounding customers.

According to the invention, the refrigeration cabinet of the type named initially has a guide, which defines a movement of the preferably partially, mostly, or completely transparent door panel between a closed position and an open position such that the pivoting region of the door panel projects less than a full width of the door panel into the external space in front of the access opening, and in which the door panel is mounted so that it can rotate about a vertical axis of rotation and can slide crosswise to the axis of rotation.

"Pivoting region" will be understood as the spatial region that is swept by the door panel when moving from the closed position to the open position and/or vice versa. "Access opening" refers to the surface of the front opening of the refrigeration cabinet, which coincides with the plane of the door when the door is closed.

Preferably, this is implemented in such a way that the guide comprises a radial or rotating bearing defining the vertical axis of rotation of the door panel, and a guide path in the plane perpendicular to the axis of rotation, along which the radial or rotating bearing or the axis of rotation is mounted moveably, and together with this latter, the door panel, in such a way that the door panel is forcibly or positively guided between a closed position and an open position, so that the pivoting region of the door panel projects less than a full width of the door panel into the external space in front of the access opening and less than a full width of the door panel into the interior space behind the access opening.

In this respect, an abstract curved or straight path is designated as a guide path; this describes the axis of rotation in the plane perpendicular to it on the path from the closed position to the open position and back. A bearing site that permits a rotational movement is designated as a radial or rotating bearing.

On the one hand, since the door panel projects into the interior space, and on the other hand, since it also projects only partially, not only is the space requirement in front of the refrigeration cabinet made smaller for swinging the doors open. The utilization of space of the refrigeration cabinet overall according to the invention is also better than, for example, that of the refrigeration cabinet of EP 2 345 347 A1 or EP 2 525 177 A1, since an additional space is not required laterally next to the refrigeration cabinet or also in its interior space for parking the doors. It should be pointed out that the invention also relates to refrigeration cabinets with several door panels, and, in particular to those with one or more double-panel doors having such door panels. Such a refrigeration cabinet forms a largely uninterrupted, transparent front. The parking position for the doors also is omitted due to the reduced pivoting region of the door panels. Therefore, shelves disposed in the interior space can be configured consistently and with straight front edges over several doors or door panels, which brings about an overall homogeneous, esthetically pleasing impression.

Particularly preferred, the door is an automatic door with a drive for moving the door panel.

First, associated with the reduced pivoting region of the doors, an automatic movement of the door is useful and easily provided, since the opening of the doors no longer blocks customers standing in front of the refrigeration cabinet, whether they are passing by or examining the goods.

The movement, which ends in an open position with the door panel partially projecting into the interior space, and the corresponding guide can be configured in various ways. Preferably, the guide path is described by a curve or alternatively by a linear guide, which are each oriented crosswise to the axis of rotation and along which is slidably mounted the radial or rotating bearing.

In both cases, these advantageous embodiments involve a rotating-sliding door. The latter makes possible in a structurally simple way a rotating of the door out from its closed position and movement along the guide path, preferably in the edge region of the access opening, in order to release the entire access opening.

The rotating movement and the sliding movement can be conducted successively or superimposed in time. The superimposed movement is preferred, since a single drive is sufficient therefor. The combined rotating-sliding movement in this case is provided via a positive mechanical coupling.

With the use of a linear guide, the drive can be configured as a linear drive, for example, in the form of a toothed belt running along the linear guide, the superimposed rotating movement being positively guided by means of a pivot or hinge assembly.

With a rotating or crank drive, both a sliding movement on a curved course as well as along a linear guide can be provided by means of an eccentrically articulated push rod, wherein the superimposed rotating movement can also be guided here positively by means of a hinge assembly, or by means of several eccentrically articulated push rods, which directly define the degrees of freedom for a complex rotating-sliding movement.

In order to implement the reduced pivoting region in the case of the guide for the rotating-sliding door, the axis of rotation of the doors in refrigeration cabinets according to the invention is preferably offset, so that it is disposed in a central region of the door panel, particularly preferred between $1/4^{th}$ and $3/4^{th}$ of the door width. This assures that the door panel can swing out only by a clearly reduced extent; the pivoting region of the door panel thus projects particularly preferred by a maximum of $3/4^{th}$ of the width of the door panel into the external space in front of the access opening and/or into the internal space behind the access opening.

"Disposed in a central region of the door panel" shall not imply that the axis of rotation must lie in the plane of the door panel. It may also be disposed outside the same, however, as long as its perpendicular projection onto the door panel preferably falls in said central region.

In the case of a curve as the guide path, this is preferably formed by a circular arc. The guide on a circular arc can be created robust and at the same time inexpensively by means of a rotating joint or hinge.

As stated, the guide can also be designed, but need not be, as straight for reasons of technical simplicity. Such a linear guide need not necessarily be aligned parallel to the access opening. For reasons of optimal utilization of space, however, it may be preferred that it runs substantially parallel and/or partly parallel to the access opening. In any case, the linear guide defines a portion of the opening movement of the door and not a parking position, unlike in the case of the refrigerated cabinet known from EP 2 345 347 A1.

Particularly preferred, on its front side underneath the access opening, the housing has a pedestal, which projects into the external space in front of the access opening by a depth that corresponds to at least the pivoting region of the door panel.

On the one hand, the pedestal serves for characterizing the pivoting region and prevents objects from being placed or persons from standing in this pivoting region. In this way, it also serves as a protection for the glass edge of the door. On the other hand, the pedestal can be used for the purpose of harboring or concealing the opening mechanism or the drive.

The radial or rotating bearing defining the axis of rotation can be formed, for example, by a bearing bush or a roller bearing and a bearing pin. In addition to any hardware or coupling elements, both bearing elements form a part of a door suspension. A door suspension is preferably provided at the upper edge and at the lower edge of the door panel. In this case, at least one of the radial or rotating bearings of the upper and the lower door suspensions also absorbs the axial force caused by the weight of the door. The second door suspension is preferably designed as floating. That is, the mechanical uncoupling means between the door panel and the housing of the refrigeration cabinet permit a relative axial movement. Any change in the distance between the upper and the lower door suspensions as a consequence of a possible deformation of the housing of the refrigeration cabinet under load can thus be equilibrated and a low-friction and low-wear operation of the door panels can be assured without excessive reinforcement of the housing.

The door preferably has an opening sensor. If the opening sensor detects a signal triggered by the customer, it causes the automatic door to open. In the simplest case, the opening sensor can be a push-button or a contact sensor on the housing or on the door. In the case of a glass door panel, the contact sensor is preferably formed by a capacitive element introduced on the glass.

Particularly preferred, however, the opening sensor has an ultrasound sensor or photoelectric sensor, which detects at least one region in the external space in front of the access opening.

In this way, the door can be opened without contact just by the customer's interruption of the light beam, which once again facilitates and accelerates access to the product. This is particularly encountered if the photo sensor advantageously runs perpendicular in front of the door panel. The customer then only needs to intuitively reach in the direction of the door panel.

It is advantageous if the refrigeration cabinet has a presence sensor for detecting a movement and/or a physical object in a detection space in front of the access opening.

The presence sensor shall primarily recognize when the customer has ended his reach to the refrigeration cabinet, so that the door can again be automatically closed, or, vice versa, can prevent the door from automatically closing as long as the customer is still reaching toward the refrigeration cabinet. This is best achieved if the detection space of the presence sensor for the most part coincides with the pivoting region of the door panel or at least a danger zone in which the customer might be standing that is associated with the movement of the door panel. Basically, the presence sensor may be suitable for recognizing obstacles in the pivoting region that have moved, such as customers, but also obstacles in the pivoting region that have not moved, such as, for example, a parked shopping cart.

The presence sensor is preferably formed either by a motion detector or by a photo sensor. The motion detector advantageously has an infrared sensor. Alternatively, a camera (CCD) or an ultrasound sensor, each with known advantages and disadvantages, can also be employed.

The opening sensor and the presence sensor may also be combined in one device, which is switched for use as an opening sensor with a closed door and as a presence sensor with an open door.

The two sensors preferably have different detection regions. Therefore, for example, the door is not often inadvertently opened, if the detection region of the opening sensor is preferably smaller than that of the presence sensor and is disposed closer to the access opening.

Furthermore, a clamping guard is preferably provided for detecting a physical object in the pivoting region of the door panel. The clamping guard alone serves for monitoring the pivoting region of the door panel and will prevent a person or an object in the pivoting region from being pinched by the door panel. In a certain sense, it represents a redundant safety measure if a presence sensor is also provided. However, it typically has a different detection region than the presence sensor and in contrast to the latter does not serve to recognize whether the closing process can or cannot be set in motion, but rather will terminate the closing process if an obstacle stands in the path. Thus, in contrast to the presence sensor, the clamping guard acts upon detecting a physical resistance during the closing and therefore presumes a contacting of the door. In addition, the presence sensor, if it is designed as a motion detector, cannot detect objects that have not moved, which can make the clamping guard necessary. The clamping guard is preferably formed by means for monitoring the power consumption or line consumption of the drive motor or by means for detecting an angular position of the drive axis.

Advantageously, a control combined with the opening sensor is provided, which is set up to detect a signal from the opening sensor, and when detected, to emit a control signal to the drive for opening the door.

Preferably, the control is set up to emit a control signal to the drive for closing the door, after the door has been opened, after a certain time period that can be selected has elapsed.

Particularly preferred, the control is set up to detect a signal of the presence sensor, and when detected, to emit a control signal to the drive for keeping the door open, or if the door has just closed, to open the door.

Preferably, an air-flow generator for producing a cold-air curtain in the interior region of the housing is provided directly behind the access opening. In this way, a free space behind the access opening not serving for presentation of goods has a double utility, i.e., as a flow region for the cold-air curtain and as a pivoting region inwardly for the doors.

DESCRIPTION OF THE DRAWINGS

Further aspects and advantages of the invention will be explained in more detail based on the embodiment examples in association with the appended figures. Herein.

DETAILED DESCRIPTION

Figure 1:
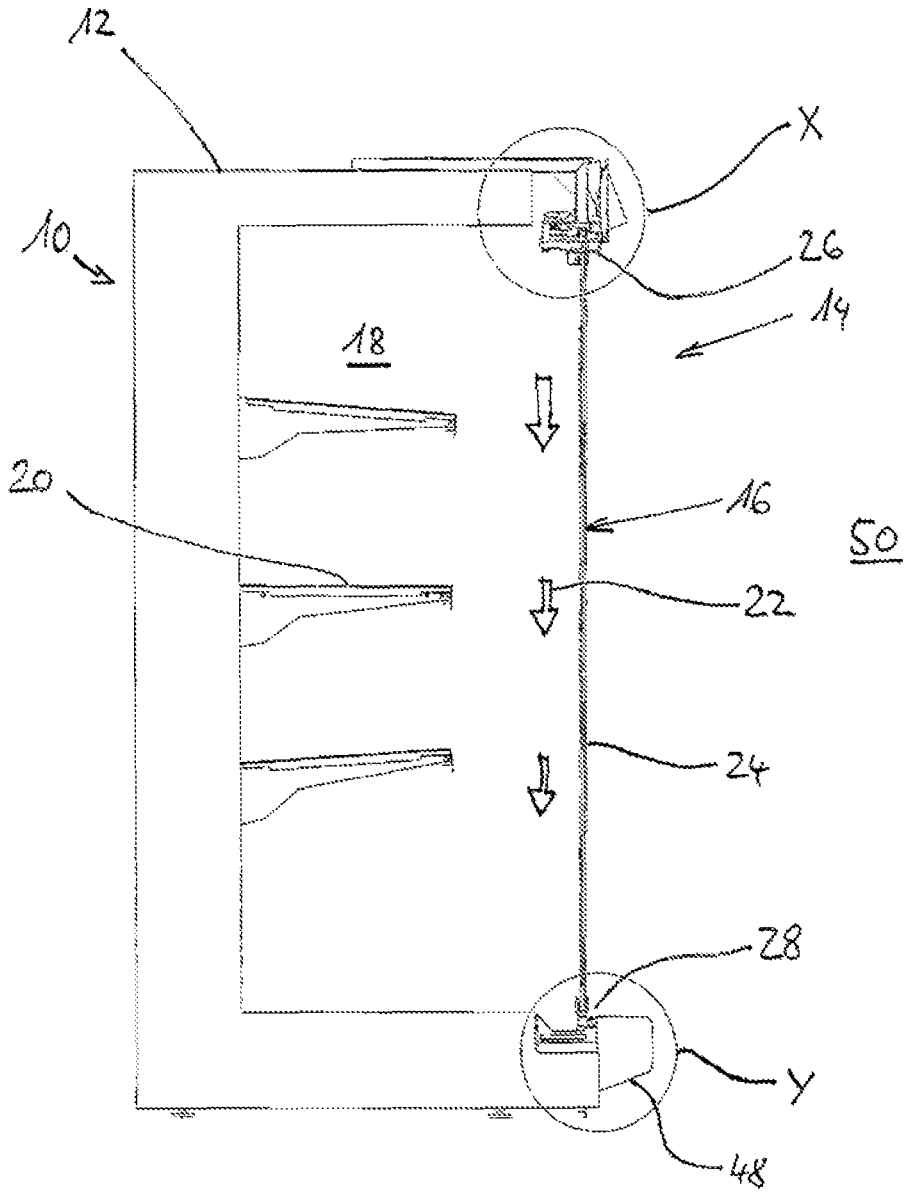
FIG. 1 shows a sectional view of the refrigeration cabinet according to the invention with closed door from the side.
Figure 2:
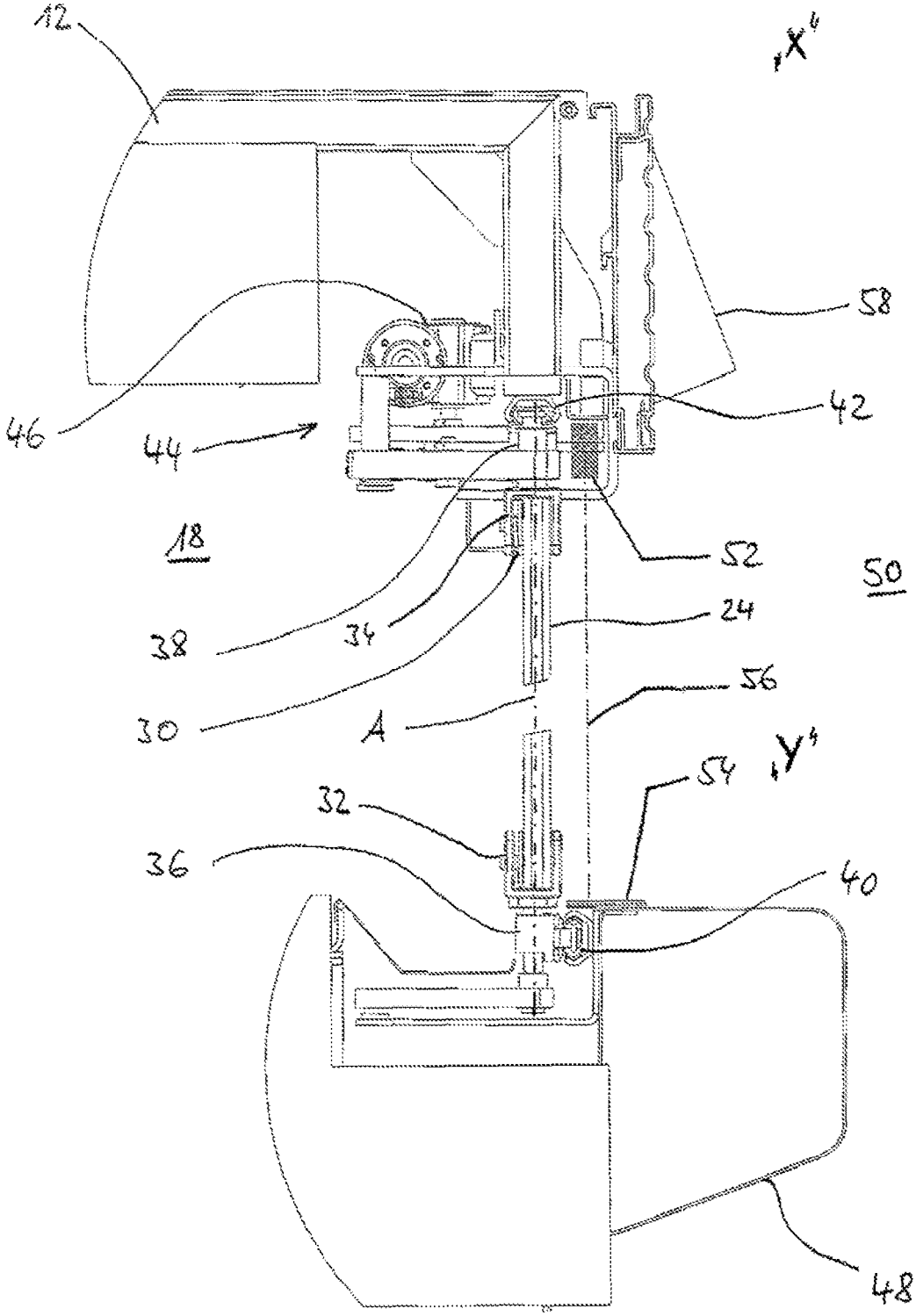
FIG. 2 shows enlarged excerpts of the refrigeration cabinet in the region of the upper and lower door suspensions.
Figure 3:
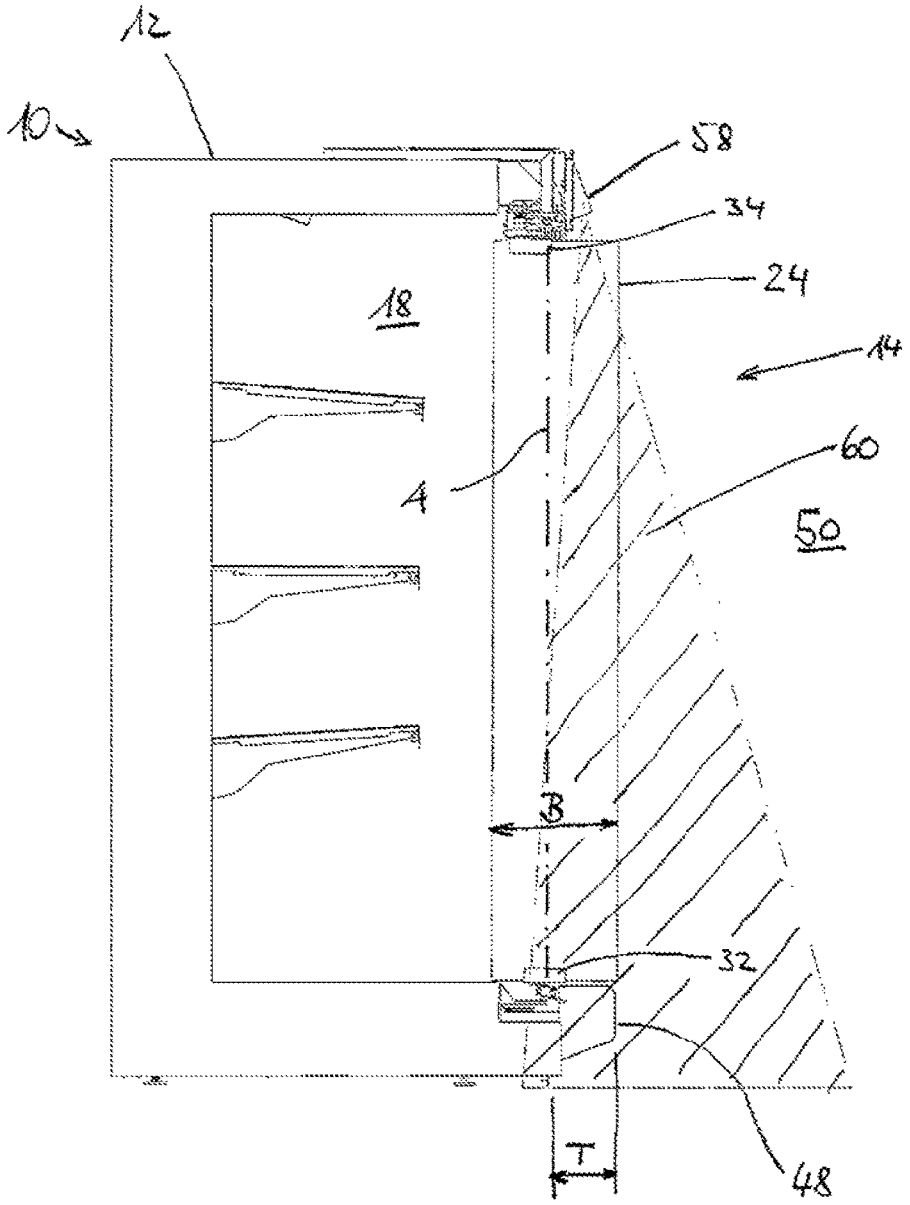
FIG. 3 shows the same sectional illustration for the refrigeration cabinet, this time with opened door.

An example of embodiment of the refrigeration cabinet 10 according to the invention is shown in section from the side in FIGS. 1 to 3. It has a housing 12 with a front access opening 14, which is closed by a door 16. In the interior space 18 of the refrigeration cabinet 10, several shelves 20 are disposed for presenting the goods to be refrigerated (not shown). A free region remains between the front edges of shelves 20 and the door 16 in the interior space 18, in which a cold-air curtain 22 flows downward from top to bottom directly behind the door 16. Further, this free space serves as a pivoting region in which the door can project into when it is opened and in the open position, without colliding with the shelves 20.

The door 16 has a door panel 24 and an upper and a lower door suspension 26, 28, which provide the guide and drive mechanism. The door suspensions 26, 28 are shown enlarged in the views "X" and "Y" in FIG. 2.

The door panel 24 is transparent over nearly its entire surface, so that the view into the interior space 18 and onto the goods is as unobstructed as possible, and is preferably composed of a safety glass and particularly preferred, a single-pane safety glass (SSG) or a laminated safety glass (LSG). The door panel can further be composed of a multi-layer insulation glass in combination with one of the named safety glasses. Further, the door panel 24 has a frame 30, in which the door panel 24 is enclosed, and which is preferably very narrow and visually unobtrusive. As has been mentioned, the refrigeration cabinet may have several such door panels, and, in particular, several two-panel doors having such door panels, which then form a largely uninterrupted, transparent front. In particular, in combination with the free space remaining between the front edges of the shelves 20 and the door 16, such a refrigeration cabinet provides a homogeneous, esthetically appealing impression, since the free space already offers sufficient space for the reduced pivoting region of the door panels and also permits the shelves to be configured consistently and with straight front edges, which are not interrupted by a door parking position.

On both its upper side and on its underside, the door panel is taken up in a U-shaped bracket 32, 34, each of which is connected to an axis of an assigned radial or rotating bearing 36, 38. The two radial bearings 36, 38 are disposed in one line and define a substantially vertical axis of rotation A, around which the door panel swings back and forth. If necessary, the axis can also be inclined somewhat from the vertical within the scope of the invention.

In turn, the rotating bearings in each case are coupled with a linear guide 40, 42. More precisely, in each case, they are connected to a carriage, which runs in a straight guide rail. The guide rail of the lower linear guide 40 is set up to predominantly absorb vertical forces and thus bears most of the load of the door 16. The guide rail of the upper linear guide 42 is set up to predominantly absorb horizontal forces and guides the door to its upper end parallel to the access opening 14.

Further, in the region of the upper door suspension, the door 16 has a drive 44 that essentially has a drive motor 46, a gear and a power transmission means. It goes without saying that the drive can also be disposed in the region of the lower door suspension. As has already been mentioned above, for example, a toothed belt or a crank in combination with one or more push rods are considered as drive elements.

In addition, a pedestal 48 that projects by a depth T into the external space 50 in front of the access opening 14, which corresponds to the pivoting region of the door panel 24, is disposed on housing 12 on its front side underneath the access opening 14. The pedestal 48 discourages customers from getting too close to the door and/or to stop in its pivoting region, and prevents objects, such as shopping carts, for example, from being able to be parked there.

The refrigeration cabinet further has an opening sensor in the form of a photo sensor, which can be best seen in the enlarged illustration of FIG. 2. In the region of the upper door suspension, the opening sensor comprises a unit 52, composed of a light source, preferably in the form of a diode laser, and a light-sensitive detector, as well as a corresponding mirror 54 in the region of the lower door suspension. The light source produces a light beam 56, which runs in front of the access opening 14 in the external space 50, and more precisely, perpendicular, in front of the door panel 24 and is directed onto the mirror 54. It is reflected by the mirror 54 and received by the light-sensitive detector in the unit 52. If the light beam of this photo sensor is interrupted in its path back and forth, then the opening sensor produces an opening signal.

The light beam 56 can be a narrow laser beam or an optically expanded beam for detecting a voluminous object. The beam is preferably fanned out in the plane parallel to the access opening, in order to detect a wider region, but at the same time, not wider than necessary into the depth of the external space 50. Also, several light sources and detectors can be provided for generating a photo sensor curtain, in order to monitor the access opening over as large an area as possible.

Further, a presence sensor 58 is disposed on the front side of the housing 12 in the region of the upper door suspension, for detecting a movement and/or a physical object in a detection space 60 in front of the access opening 14. The presence sensor 58 is a motion detector in the case shown. In contrast to the detection region of the opening sensor, the detection region 60 preferably extends into the depth of the external space 50 in front of the refrigeration cabinet, in order to be able to recognize in a timely manner a person who is moving close to the open refrigerated cabinet. The detection region further extends directly into the access opening and in fact, a small way into the interior space 18 of the refrigeration cabinet 10, in order to assure that, in particular, the pivoting region of the door panel is not changed. If a person moves into the detection region 60 of the presence sensor 58, then the latter generates a presence signal.

The opening sensor and the presence sensor are connected to a control (not shown), which is set up to detect the opening signal of the opening sensor, on the one hand, and upon detecting it, to emit a control signal to the drive 44 for opening the door 16. A closing process is preferably introduced after a selectable time interval of 5 to 15 seconds after opening, by emitting a control signal to the drive 44 for closing the door 16. On the other hand, the control is set up to detect the presence signal of the presence sensor 58 and upon detecting it, to emit a control signal to the drive 44 for keeping the door 16 open, or, if the door 16 is in the midst of closing, to halt the closing process and/or to open the door 16 again.

Further, a clamping guard for detecting a physical object can be provided in the pivoting region of the door panel 24, which is also connected to the control. The latter indicates by emitting an obstruction signal when a person or an object moves into the pivoting region of the door. The control is then set up to detect the obstruction signal of the clamping guard and if detected, to emit a control signal to the drive 44 for halting the closing process and/or to open the door 16 again. The clamping guard thus represents a redundant safety measure to a certain extent, since the presence sensor also assures that the door is not closed while persons or objects are found to have moved into the pivoting region of the doors. Of course, the clamping guard also prevents objects that have not moved from being caught by closing doors. The clamping guard is preferably formed by means for monitoring the power consumption or line consumption of the drive motor.

The door is shown completely swung open in FIG. 3. It can be seen that the door panel 24 in this open position projects partially into the interior space 18 enclosed by the refrigeration cabinet 10. It can also be seen that the axis of rotation A is disposed in the direction of width B in a central region of the door panel 24. More precisely, this axis does not run centrally through the door panel, but within a region around the center of the door panel 24, which is distanced by $\frac{1}{4}^{th}$ of the width of the door panel from each of the two lateral edges of the door panel.

Figure 4:
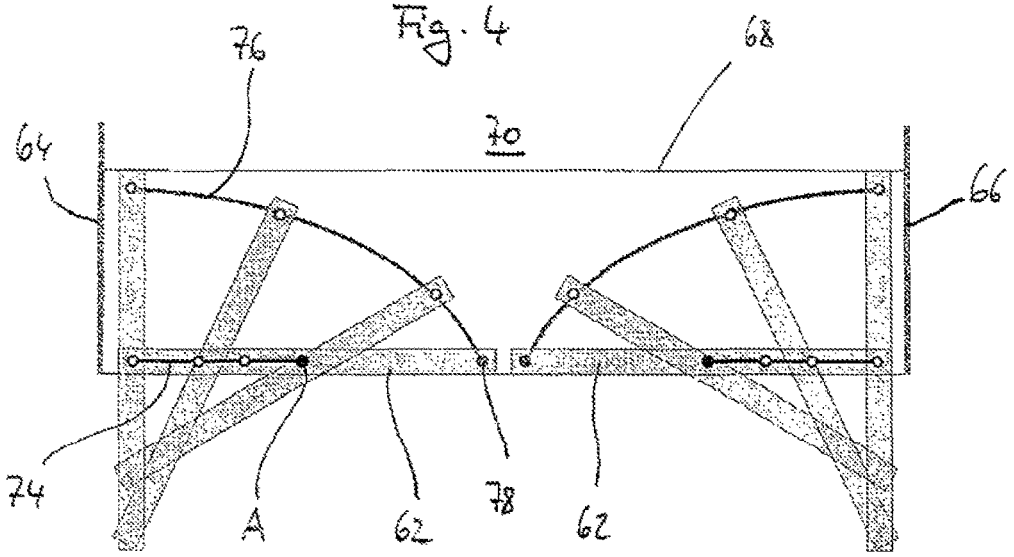
FIG. 4 shows a schematic illustration of a first guide design for an automatic door.

A first example of embodiment of a guide that defines a movement of the door panel 62 between a closed position and an open position is shown schematically in FIG. 4. The refrigeration cabinet is shown only greatly simplified in top view and in the periphery of its two side walls 64, 66. The line 68 bounds the pivoting region of the two door panels 62 in the interior region 70 of the refrigeration cabinet and thus indicates the outermost possible position of the front edges of the shelves. Here, as an example, a refrigeration cabinet having two door panels per door is shown, which carry out a mirror-symmetrical movement and travel into an open position close to and parallel to the outer walls 64, 66. In the following, the opening movement will be described only on the basis of one door panel; the movement of the second door panel occurs simultaneously and mirror-symmetrically.

The door panel 62 first pivots about its vertical axis of rotation A and in this case, in fact, inwardly in the center of the refrigeration cabinet. Even after the door panel has swung out slightly from the closed position, it is shifted with the axis of rotation along the linear guide 74 parallel to the access opening in the direction of the side walls with simultaneous overlapping, continued pivoting movement into the open position. The door panel 62 is positively guided by its end pointing to the center of the door along a curve path 76. For this purpose, for example, a guide pin is disposed on the door panel, which engages in a corresponding arc-shaped guide rail. The movement is thus limited to a single degree of freedom by the linear guide 74 of the axis of rotation A on one side, and by the curve path 76 on the other side.

Figure 5:
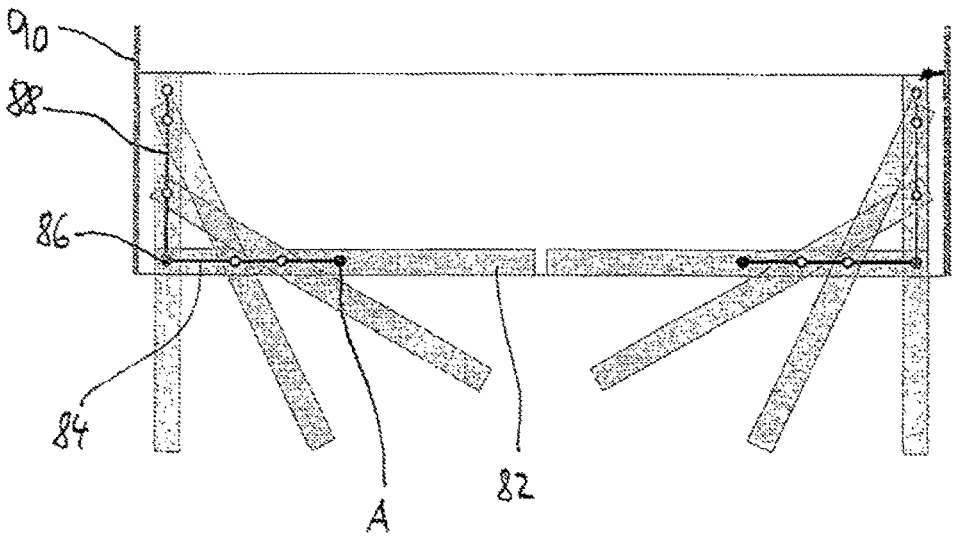
FIG. 5 shows a schematic illustration of a second guide design for an automatic door.

Another guide concept for the door of the refrigeration cabinet according to the invention is shown in FIG. 5. In agreement with the example of embodiment according to FIG. 4, the door panel 82 is also mounted in a rotatable manner about a vertical axis of rotation A in the central region of the door panel, the axis of rotation A being slidable along a linear guide 84 parallel to the access opening. Unlike the example of embodiment according to FIG. 4, the door panel 82, however, swings outwardly in the center of the refrigeration cabinet. This movement is forced by guiding the door panel by means of a guide pin 86 disposed on its outer end along a second linear guide 88 parallel to the side wall 90 and thus perpendicular to the linear guide 84. Also, the movement of the door panel 82 is thus limited to a single degree of freedom.

Figure 6:
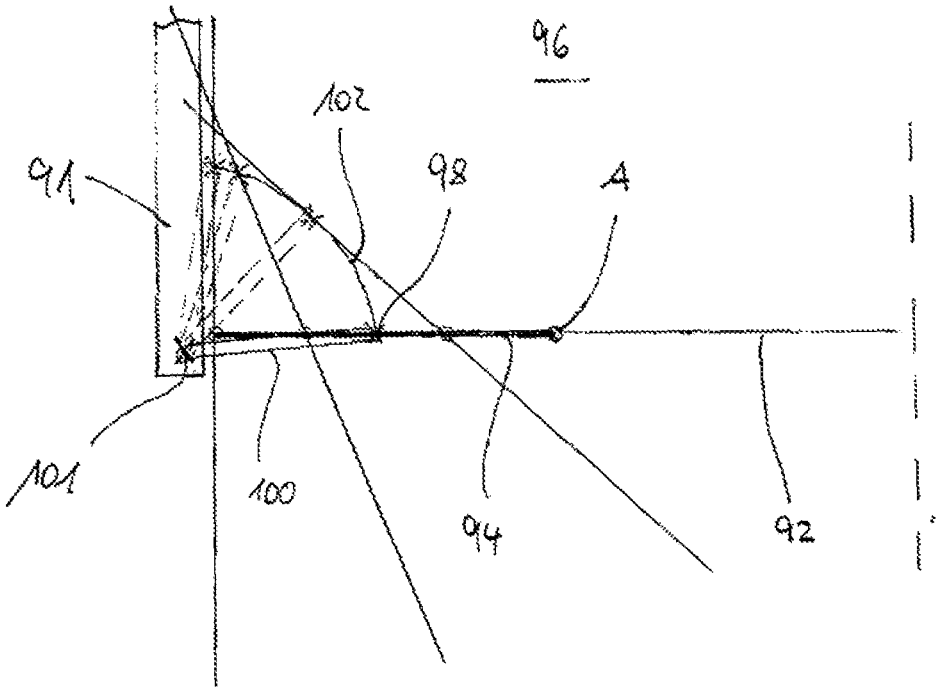
FIG. 6 shows a schematic illustration of a third guide design for an automatic door.
Figure 7A:
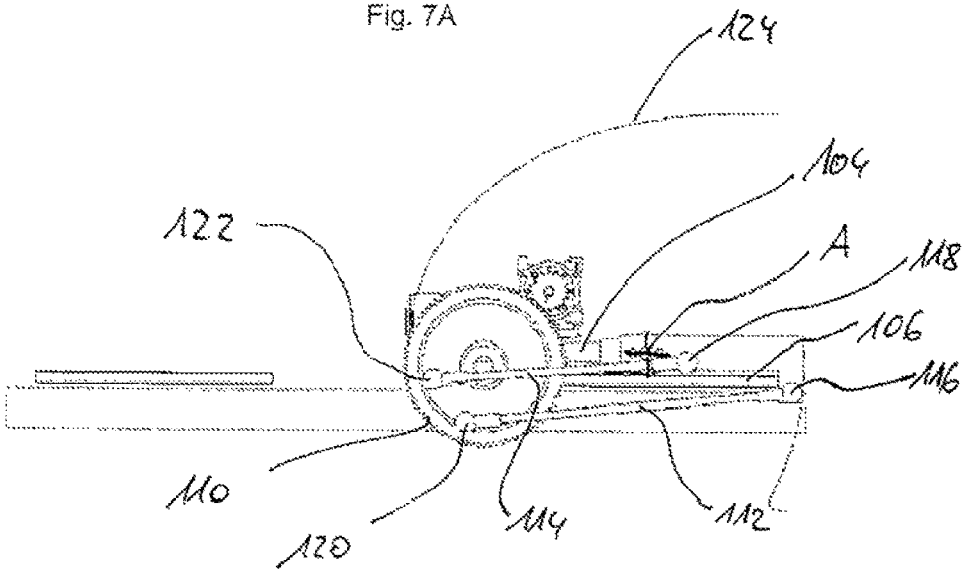
FIGS. 7A-D show a top view onto the drive mechanism of a fourth guide and drive design for an automatic door.
Figure 7B:
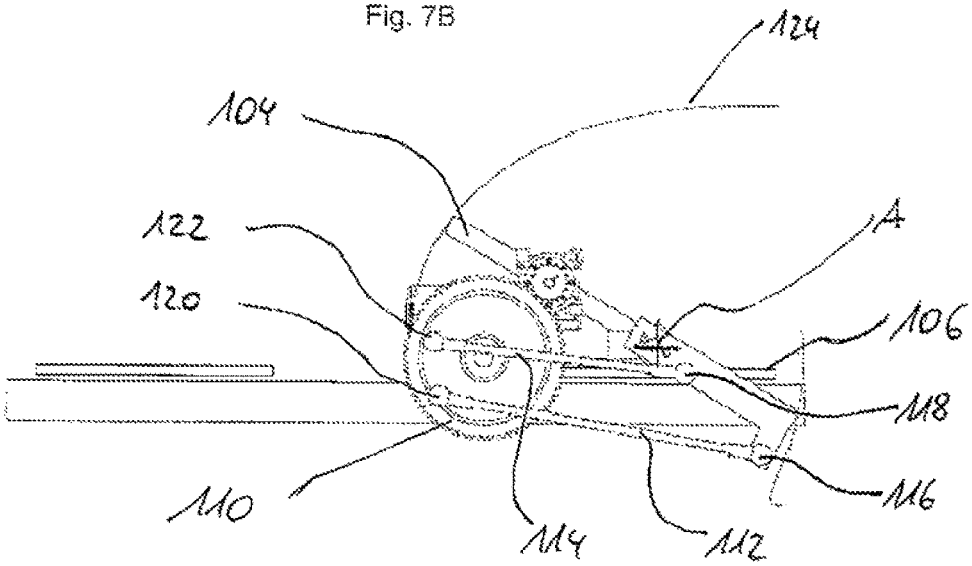
Figure 7C:
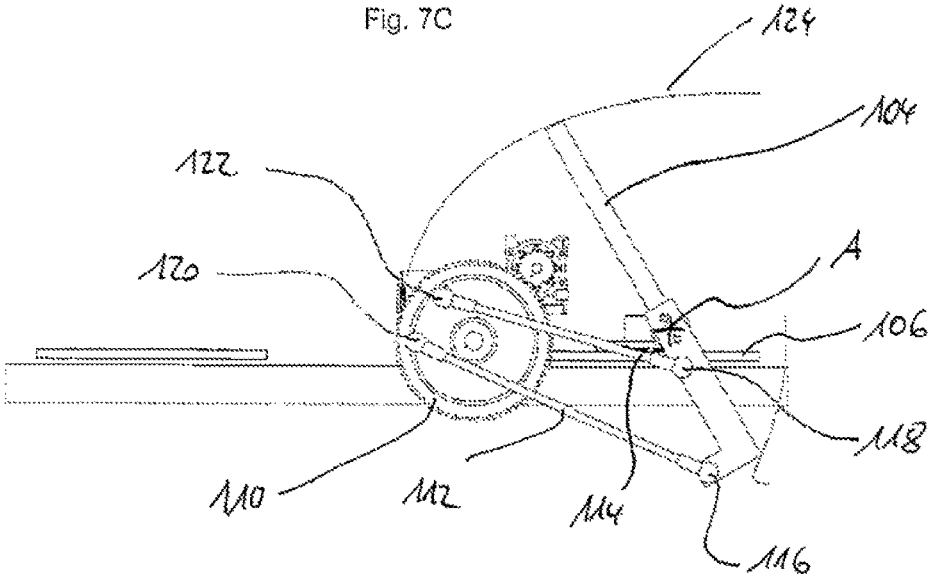
Figure 7D:
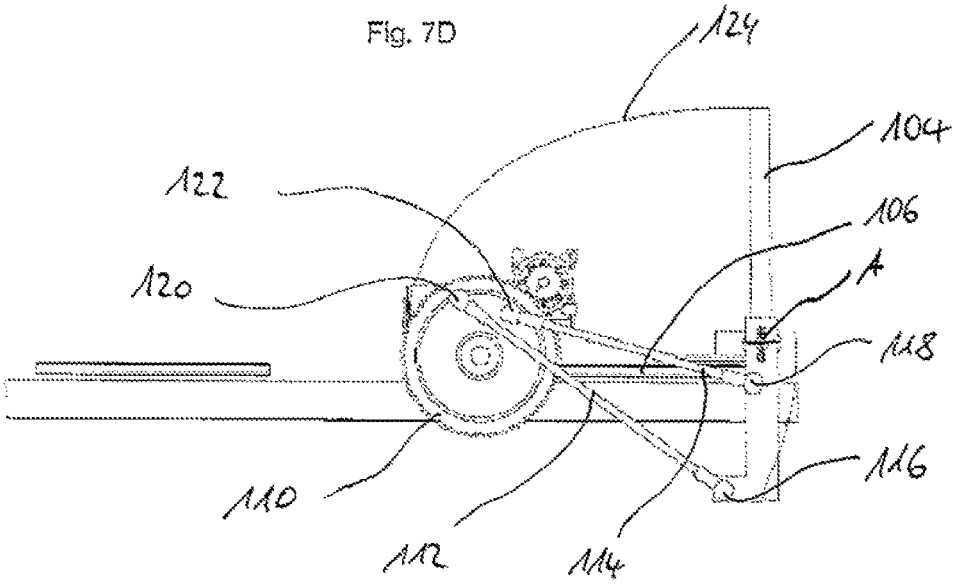
Figure 8A:
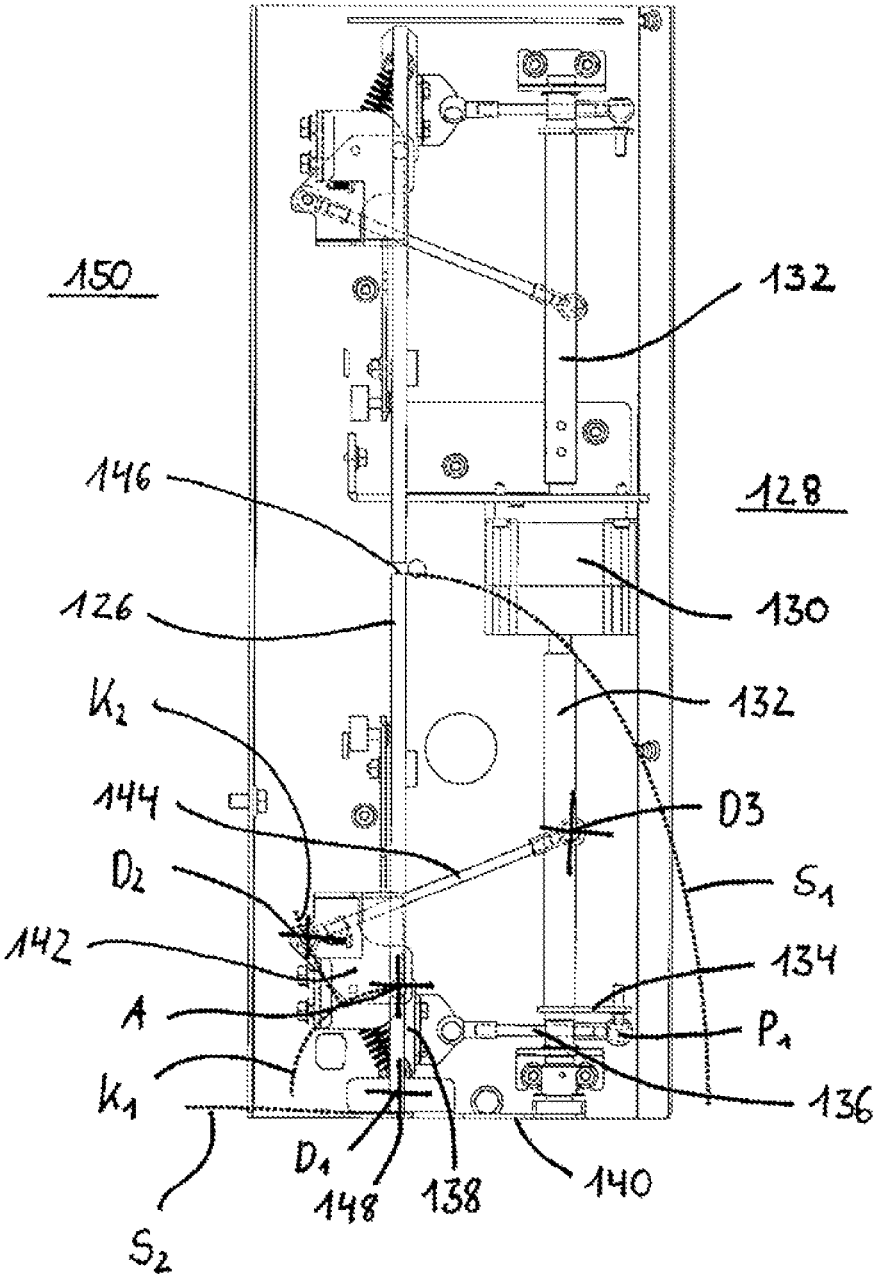
FIGS. 8A-D show a top view onto the drive mechanism of a fifth guide and drive design for an automatic door.
Figure 8B:
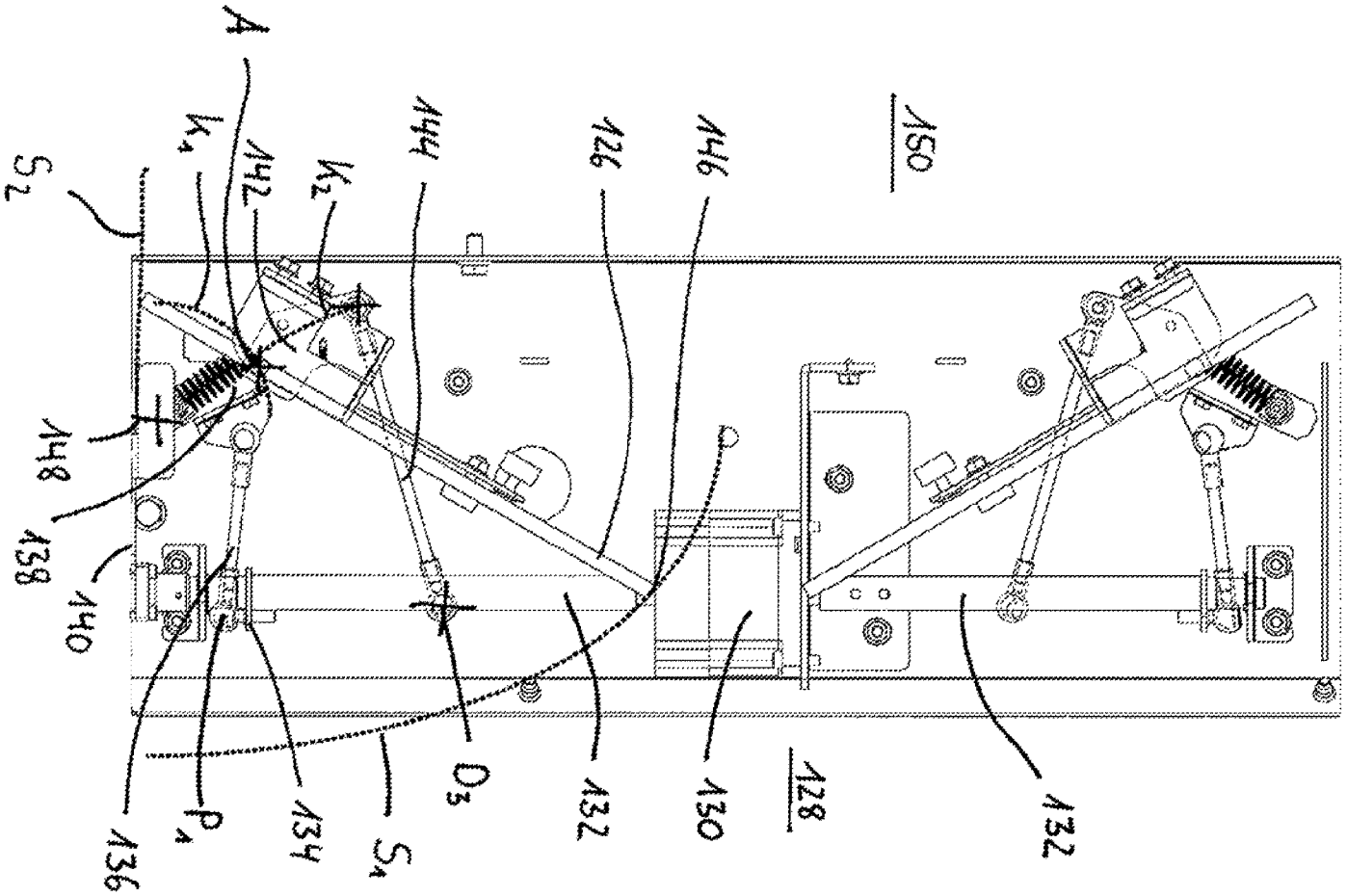
Figure 8C:
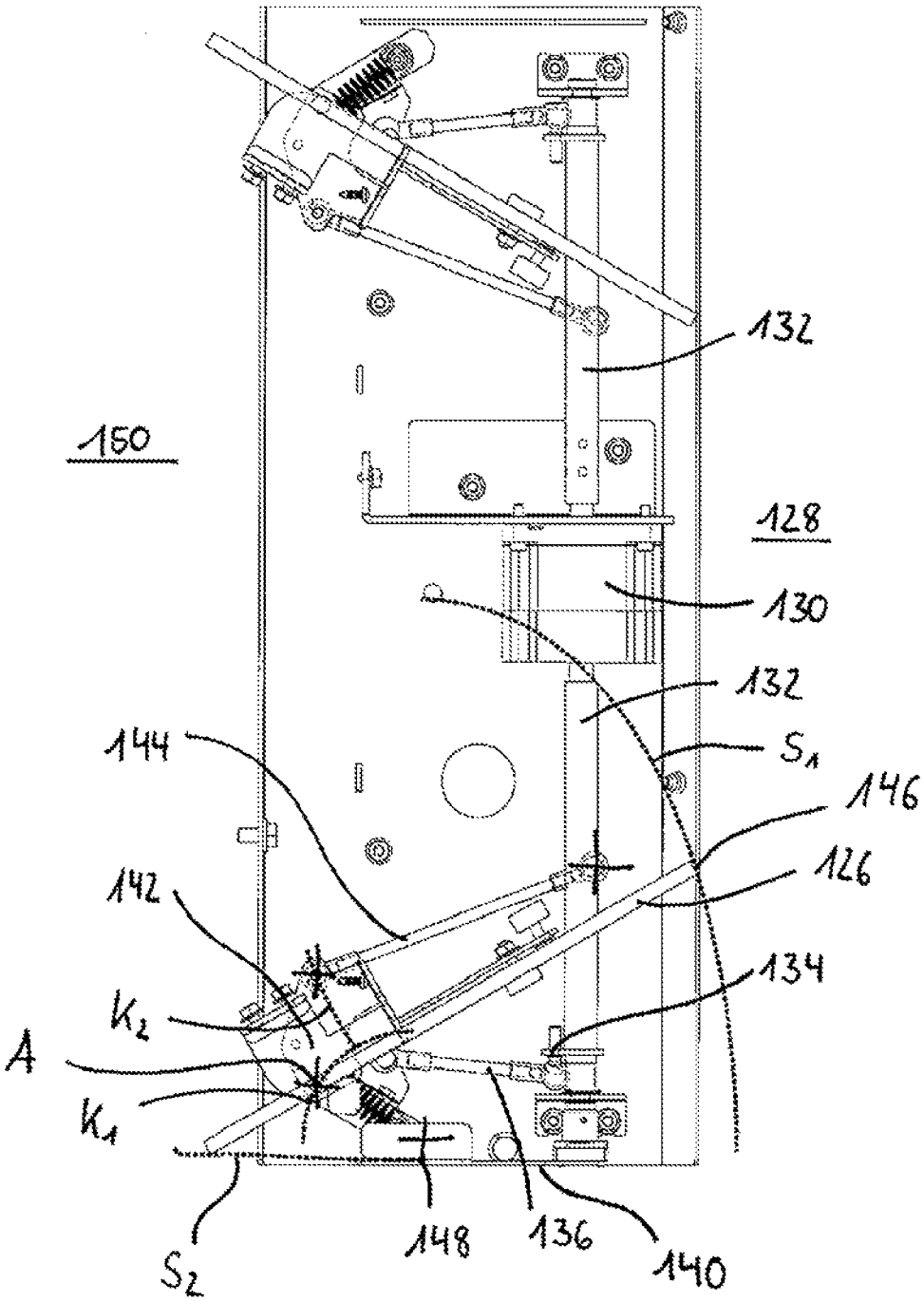
Figure 8D:
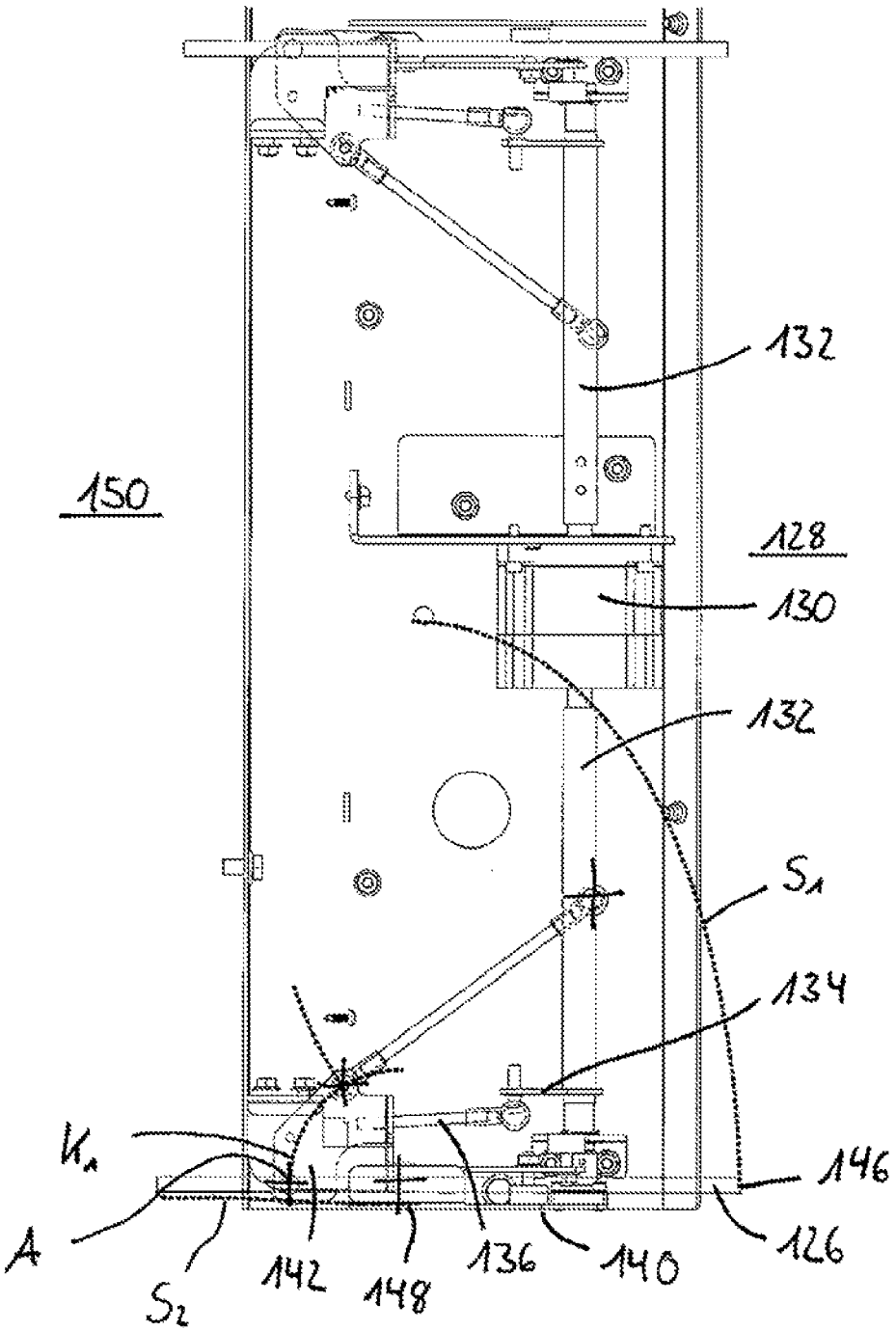
Figure 9A:
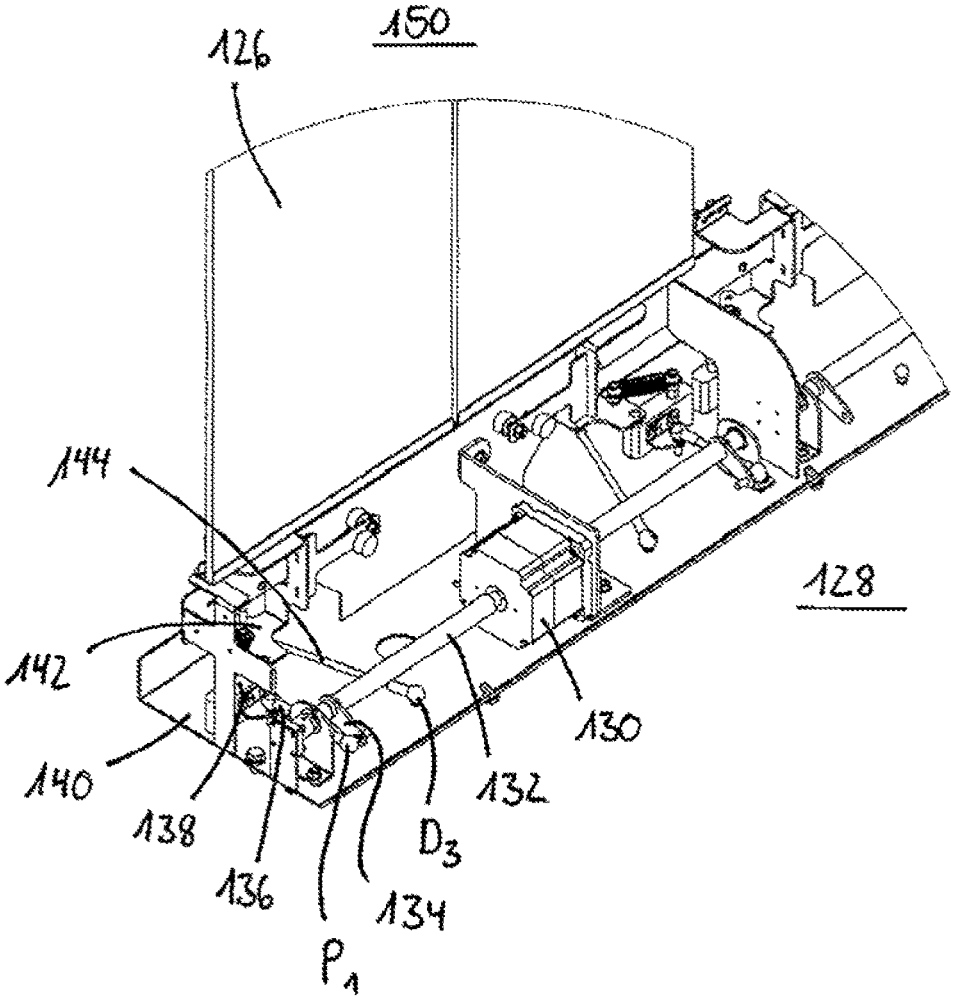
FIGS. 9A-D show a perspective view of the drive mechanism of a fifth guide and drive design for an automatic door.
Figure 9B:
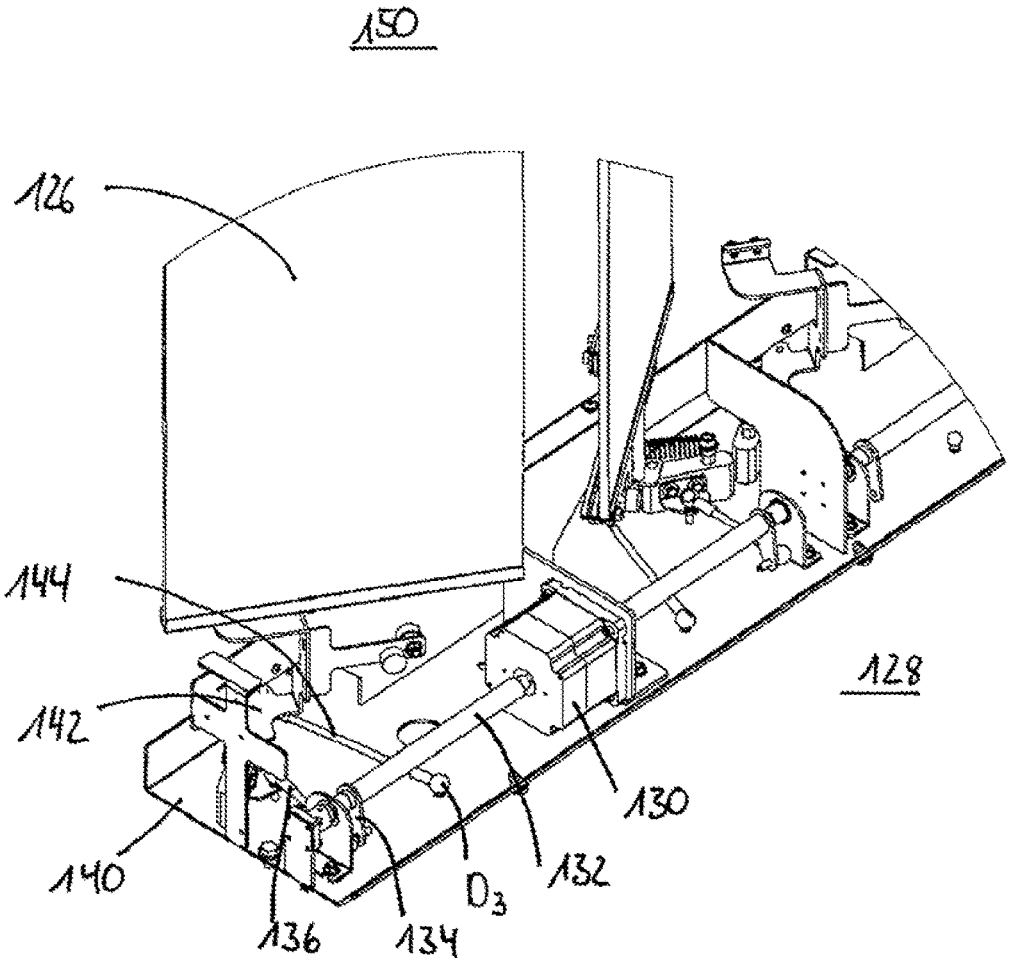
Figure 9C:
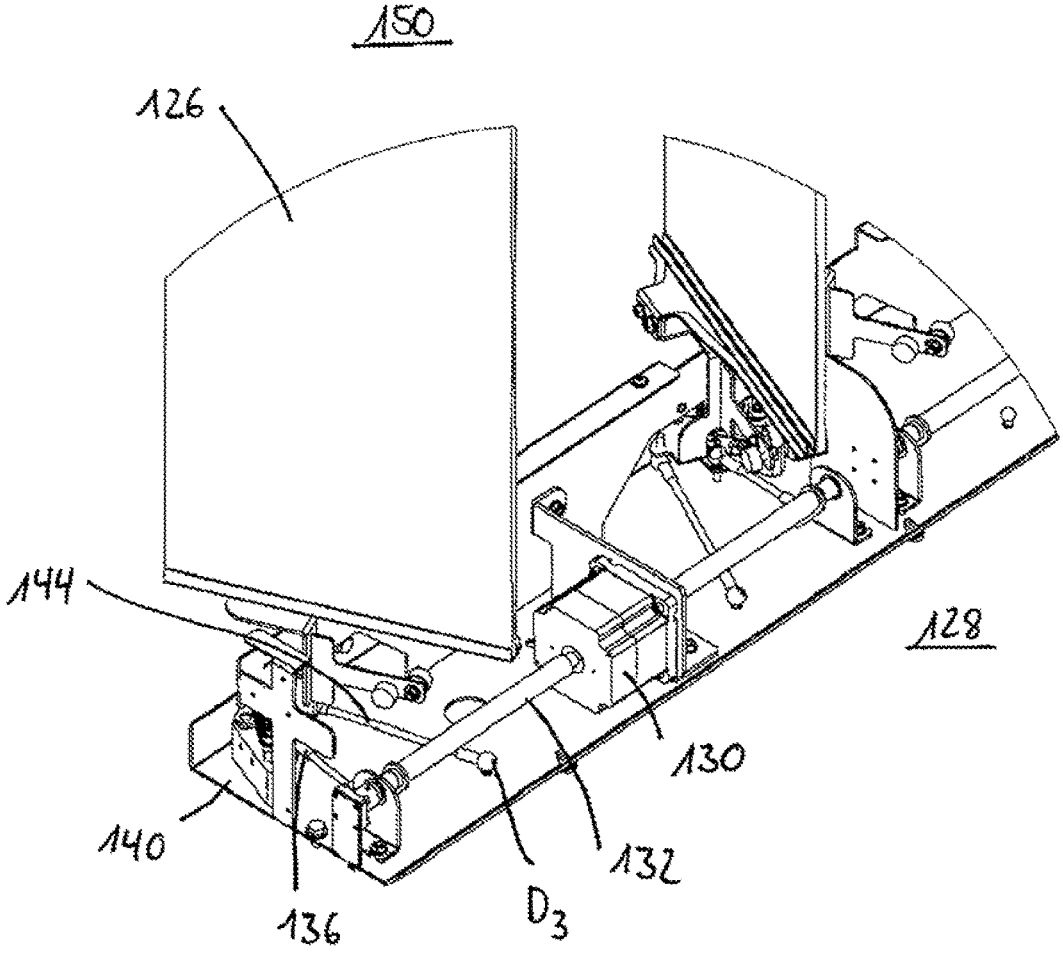
Figure 9D:
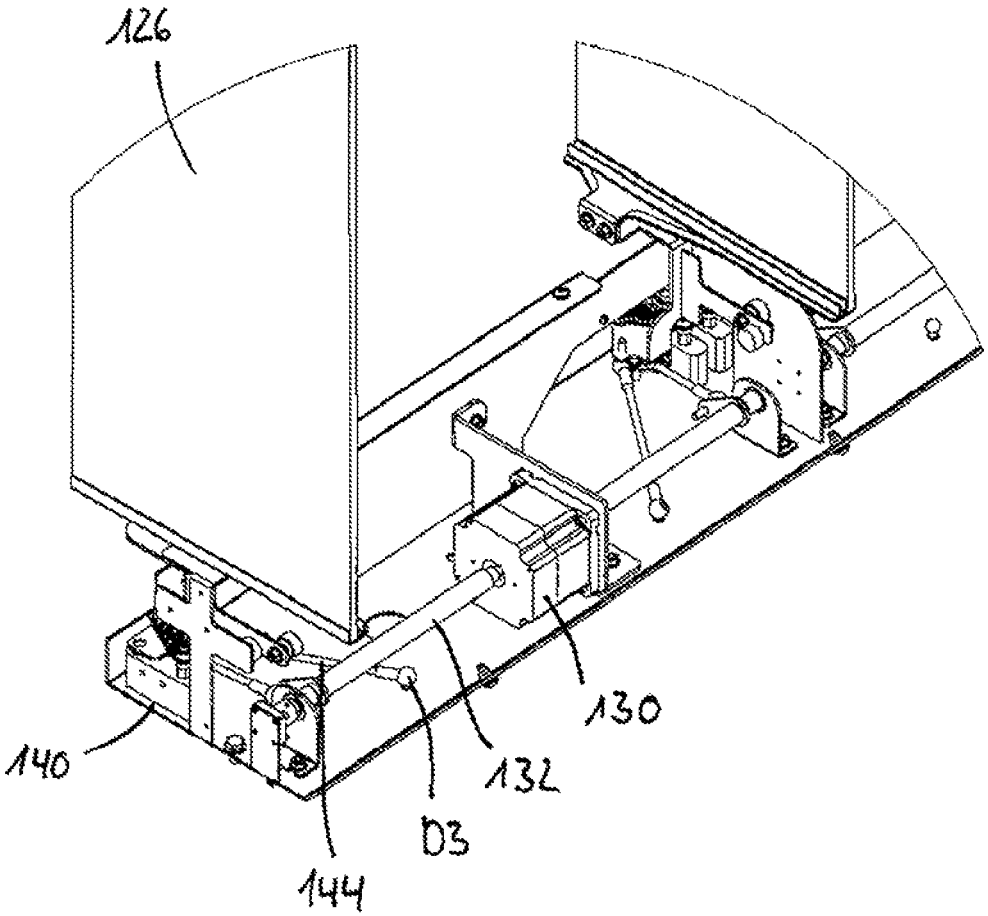
Figure 10A:
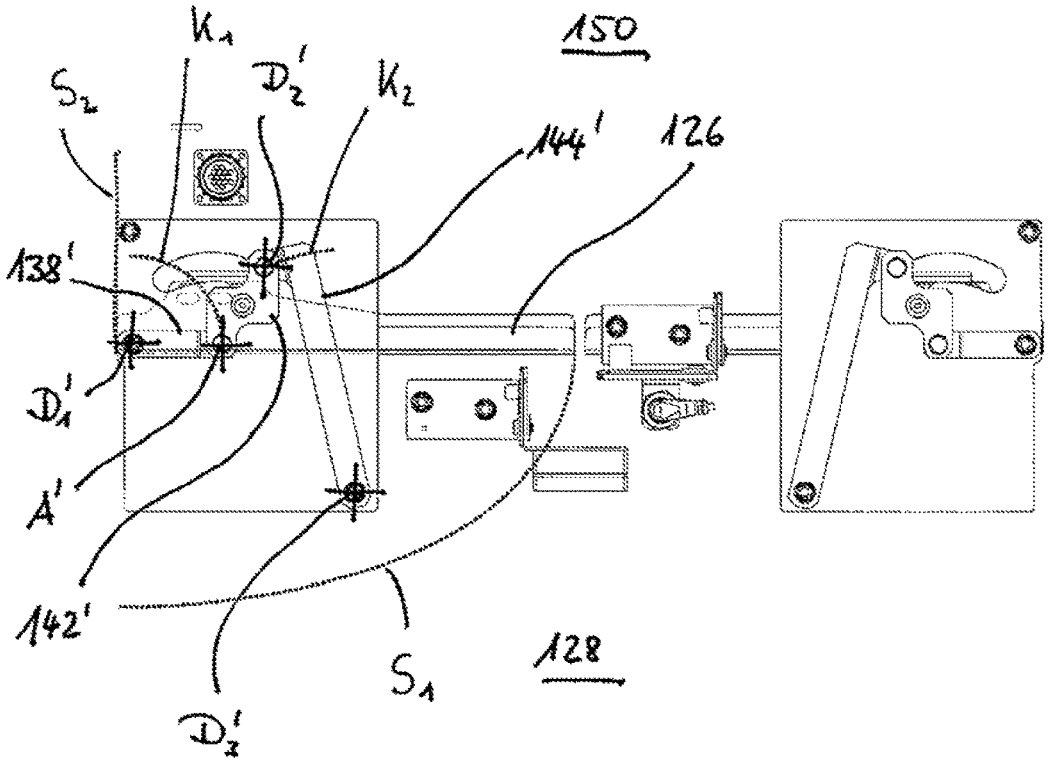
FIGS. 10A-D show a top view onto an upper guide mechanism of the fifth guide and drive design for an automatic door.
Figure 10B:
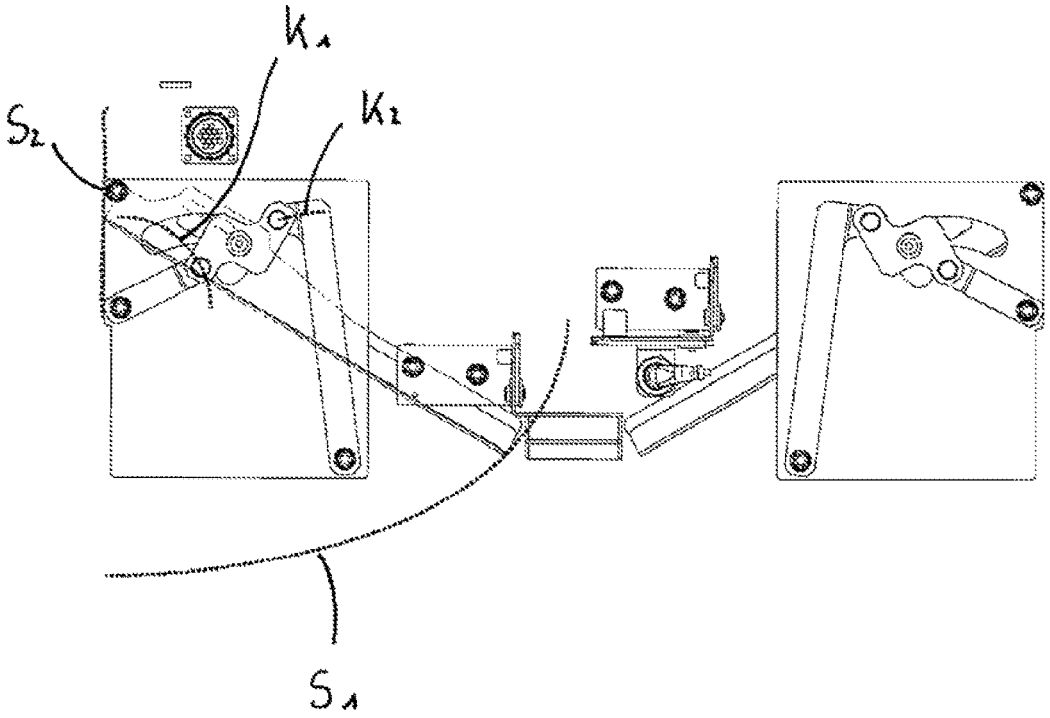
Figure 10C:
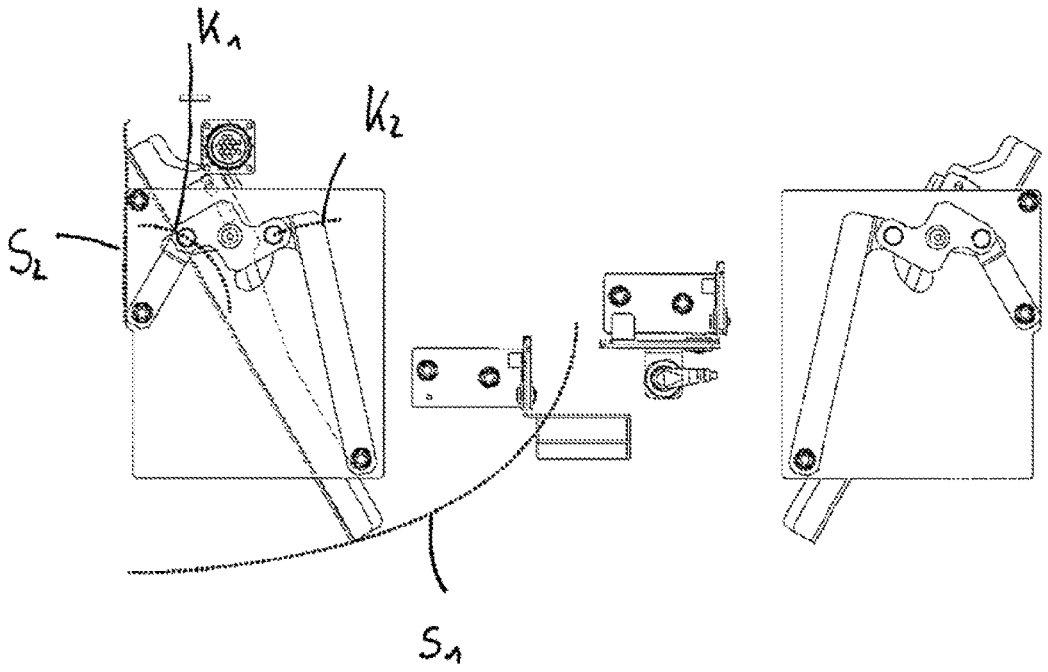
Figure 10D:
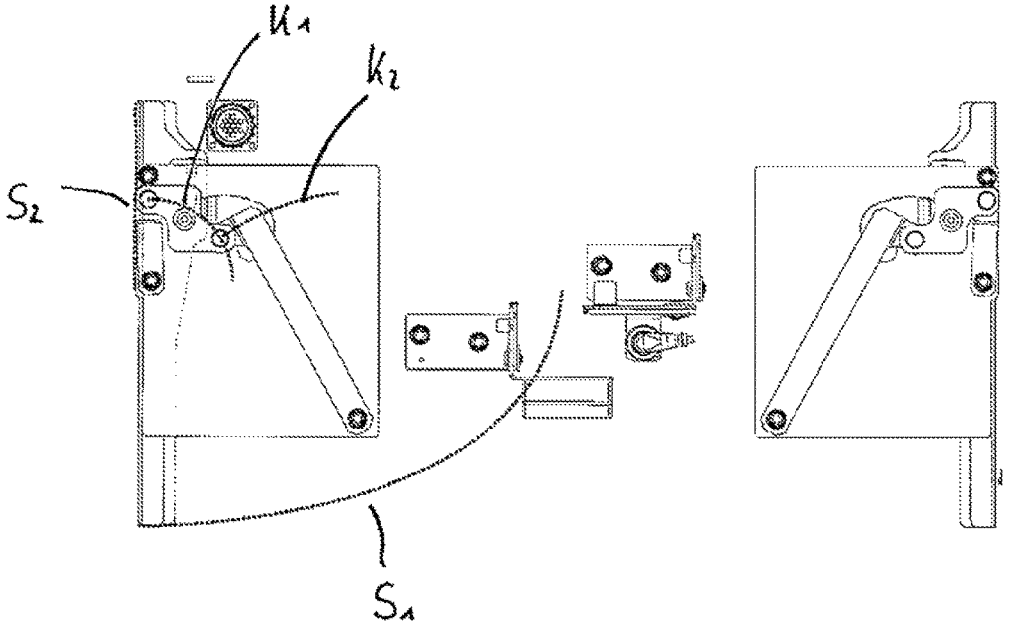
Figure 11A:
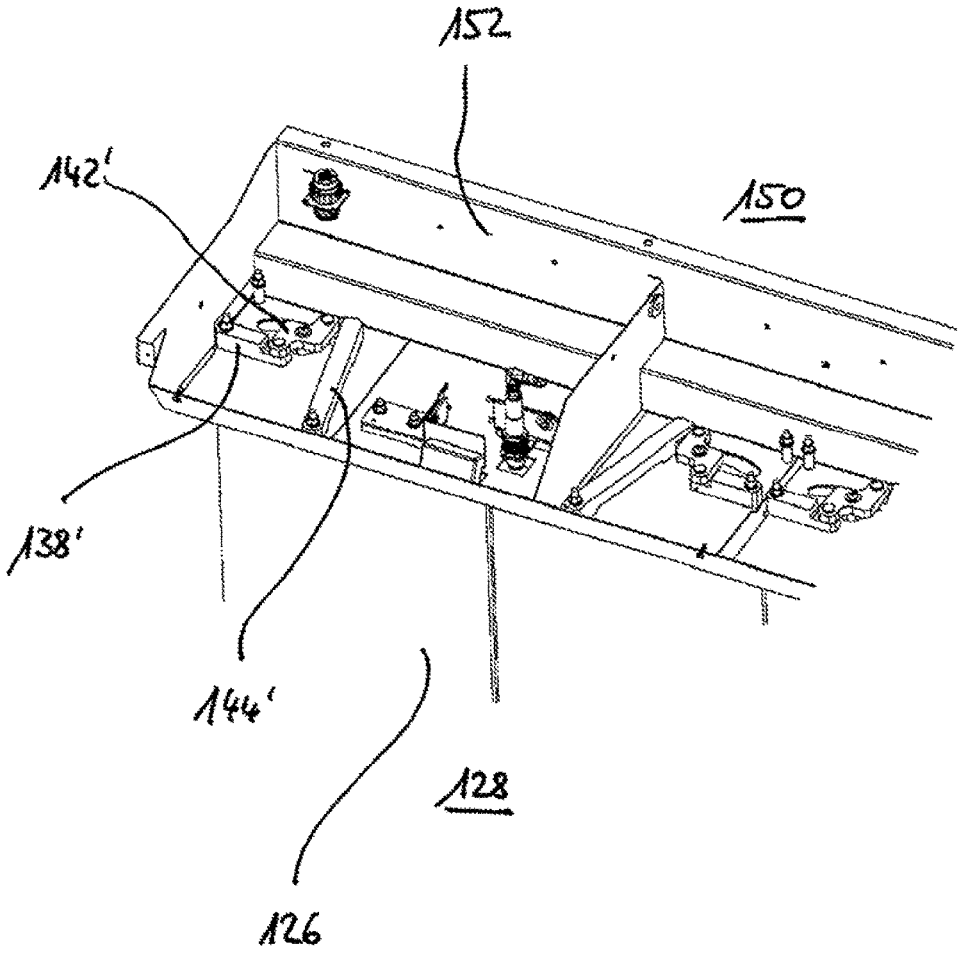
FIGS. 11A-D show a perspective view of the upper guide mechanism of the fifth guide and drive design for an automatic door.
Figure 11B:
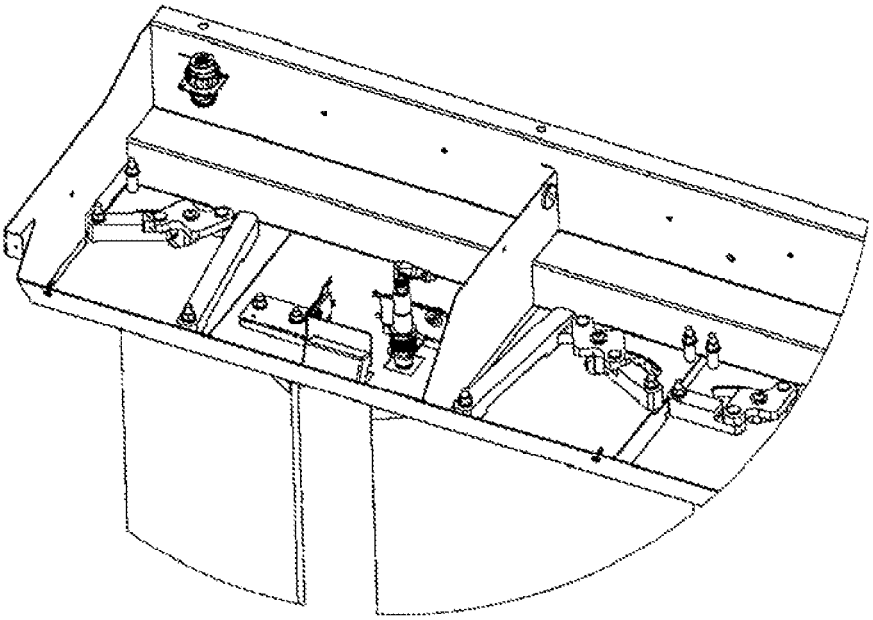
Figure 11C:
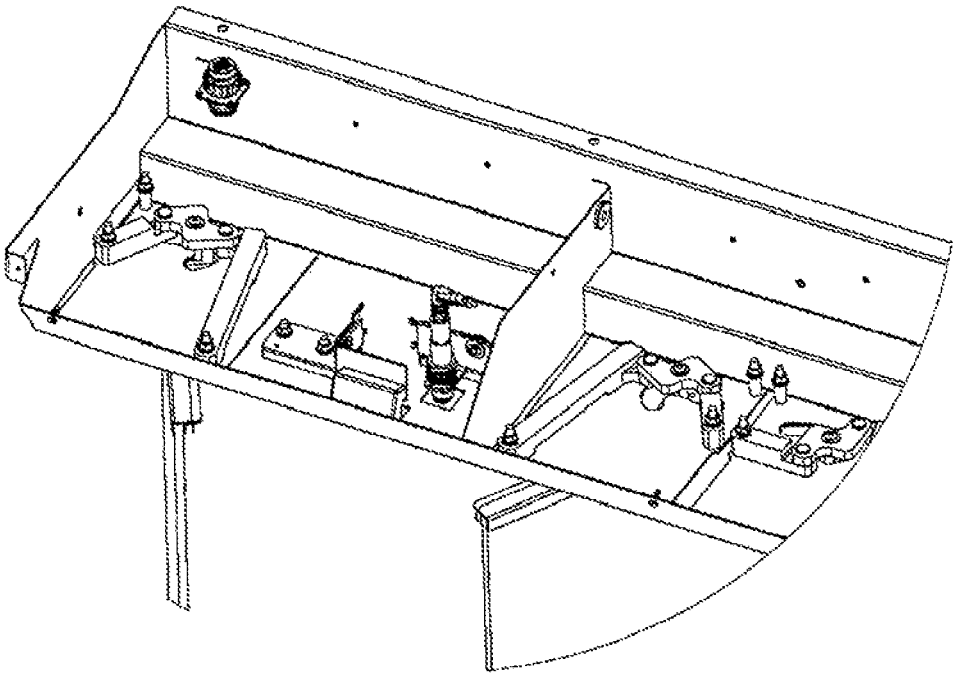
Figure 11D:
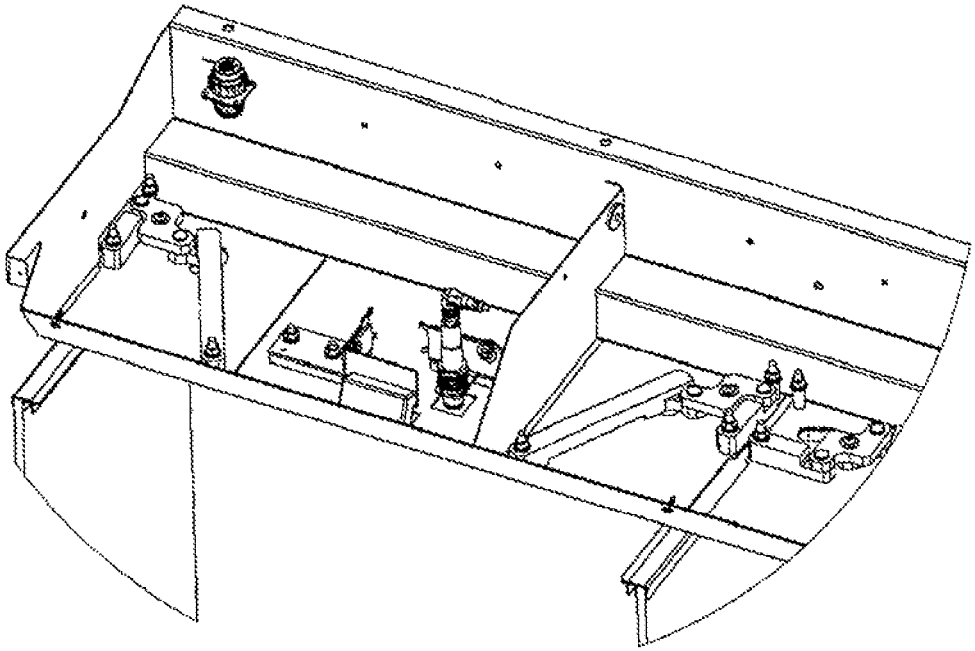

The guide mechanism of a third example of embodiment is shown in FIG. 6, but it is demonstrated only on the basis of one door. The excerpt of a side wall 91 is shown; the interior space 96 of the refrigeration cabinet is found to the right thereof and above the door panel 92. The example of embodiment according to FIG. 6 has in common with the two embodiment examples described above the fact that the door of the refrigeration cabinet is formed as a rotating-pivoting door 92, which is mounted rotatably about a vertical axis of rotation A and is slidable along a linear guide 94 parallel to the access opening together with this vertical axis of rotation. The door panel 92 is further articulated at a rotating point 98 between the laterally outer end of the door panel and the axis of rotation A at a pivoting lever 100, which is articulated so that it can pivot at an articulation point 101 lying opposite the rotating point 98 in the lateral edge region of the access opening on the housing of the refrigeration cabinet. The rotating point 98 of the door panel 92 is forcibly guided thereby on a circular path 102, so that the door panel in combination with the linear guide 94 is also limited in its movement to one degree of freedom between the closed position and the open position.

The example of embodiment according to FIGS. 7A to 7D shows a combined solution for the guide and the drive of the door. The door panel 104 in turn can be rotated about a perpendicular axis of rotation A and can be mounted so that it can slide together with this along a linear guide 106. The positive or forced guide of the door, i.e., the coupling of the rotating and sliding movement in this case is carried out via two rigid push rods 112, 114 mounted on a disk crank 110 of the drive. The two push rods engage at two spaced-out articulation points 116, 118 on the door panel 104. Both articulation points 116, 118 are found on the same side of the axis of rotation A, one 118 in approximately the plane of the door panel 104 and the other 116 clearly outside the plane of the door panel 104. The push rods 112, 114 are articulated on their opposite-lying ends to two crank pins 120, 122 of the disk crank 110 that are distanced from one another in the peripheral direction. By means of a rotation of the disk crank 110, the door panel 104 moves with a combined pivoting-rotating movement from the open position into the closed position. The outer pivoting region is characterized by the arc line 124 in the projection. This shows that in a coupled movement, the door first essentially pivots out from the closed position and subsequently slides essentially linearly into the open position.

The example of embodiment according to FIGS. 8A to 8D in top view, and FIGS. 9A to 9D in perspective view show an alternative, combined solution for the guide and the drive of a door. The door is again configured as a two-panel door. Since both doors as well as their drive and guide are constructed mirror-symmetrically, the mechanism will be described as representative on the basis of only one door.

Unlike the embodiment of FIGS. 7A to 7D, the door panel 126 swings open centrally in the direction of the interior space 128 of the refrigeration cabinet. For this purpose, it is mounted rotatably about a perpendicular axis of rotation A and slidably together with this along an arcuate curve K. The positive guide of the door, i.e., the coupling of the rotating and sliding movement in this case is carried out via a multiple rotating joint or hinge construction, which is described in the following.

A drive motor 130 acts on a common shaft 132 for both door panels. A crank 134 is introduced on both sides of the drive shaft and a push rod 136 is articulated with it around a rotating point $P_1$, which acts on a lever 138 at its other end. On one side, the lever 138 is articulated rotatably about an axis of rotation $D_1$ on the housing 140 of the refrigeration cabinet. On the other side, the lever 138 is connected to a support 142 for the door panel 126 in a rotatable manner about the axis of rotation A. The door panel 126 is disposed on the support 142, so that the axis of rotation A falls in the central plane of the door panel 126. The support is distanced from the axis of rotation A in order to connect another axis of rotation $D_2$ rotatably to a first end of a link rod 144, whose second end is articulated around an axis of rotation $D_3$ on the housing 140. All above-described axes of rotation are perpendicular to the plane of illustration of FIGS. 8A to 8D. In contrast, rotating points have two degrees of freedom.

The set of movements when the door is opened accordingly are as follows: The push rod 136 converts a rotation of the drive shaft 132 into a push movement, with which the lever 138 is pivoted around the axis of rotation $D_1$. The lever thus forms a rotating joint or hinge, which guides the axis of rotation A of the door panel on an arcuate curve $K_1$, which in the lower case is deflected counterclockwise. Likewise, the support 142 and with it the door panel 126 rotate about the axis of rotation A in the clockwise direction, so that the door panel 126 is swung open to the interior space 128, as is shown in the sequence of the FIGS. 8A to 8D and 9A to 9D. The rotating movement of the door panel and the sliding movement of the axis of rotation are positively coupled by the link rod 144, which forces the support at the site of the axis of rotation $D_2$ onto another arcuate curve $K_2$ about the axis of rotation $D_3$. When the door is closed, the movements are produced in the reverse direction.

Upon pivoting, the door panel with its edge 146 pointing to the center of the housing sweeps over a pivoting region that is bound by the edge curve $S_1$, and with its edge 148 pointing to the edge of the housing sweeps over a pivoting region that is bound by the edge curve $S_2$. It can be well recognized that the door panel thus in fact swings open to the interior space 128 behind the access opening, but in this case also the path into the external space 150 in front of the access opening.

The common shaft 132 brings about a positive mechanical coupling between both door panels of the double door. This positive coupling brings about a synchronous opening and closing of both door panels and also occurs in the case of manual operation. Basically, a manual operation can be provided as a less expensive variation without drive motor and associated sensors or can also be considered as an emergency operation with an automatic system.

The drive and guide mechanism, which is shown in FIGS. 8A to 8D in top view and FIGS. 9A to 9D in perspective view, preferably forms the lower door suspension and is preferably hidden underneath the access opening in a pedestal of the housing of the refrigeration cabinet. This embodiment with a guide path that is described by a curve and is realized by means of a lever, in contrast to one with guide rails as shown in the preceding examples, has the advantage that the pedestal can be configured with a closed upper surface without any through-passages for guide elements, such as guide pins, for example. The surface of the pedestal can be cleaned easily and more thoroughly thereby.

Figure 12:
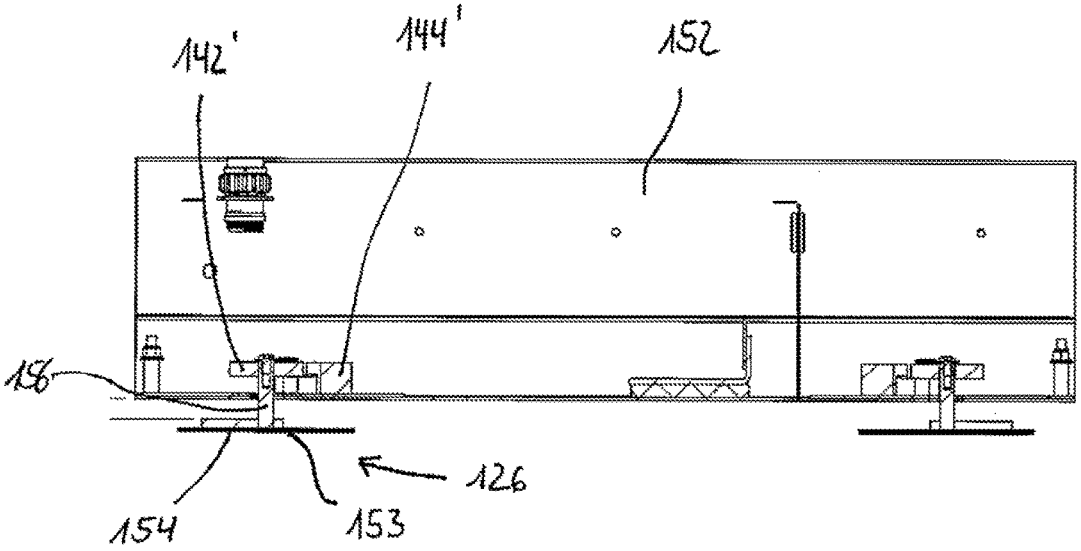
FIG. 12 shows a front view of the same upper guide mechanism.

In FIGS. 10A to 10D in top view, FIGS. 11A to 11D in perspective view, and in FIG. 12 in front view, the upper door suspension that is complementary to the previously described lower door suspension is shown, the upper suspension being distinguished from the lower one essentially only by the absence of the active drive components: drive motor, drive shaft, crank and push rod. The guide components of first link arm 138', guide plate 142' and second link arm 144', which are complementary to the lever 138, the support 142, and the link rod 144, at least relative to the arrangement of their axes of rotation $D_1'$, $D_2'$, and $D_3'$ and A' are the same as the construction of the lower door suspension, so that they enable identical movement sequences. The first link arm 138' and the second link arm 144' are again articulated rotatably to a housing 152 of the refrigeration cabinet, which at the same time serves for a covering of the mechanism. The guide plate 142' is suspended between the first and the second link arm and rotates synchronously with the door panel 126 about the axis of rotation A'.

In the front view, the upper door suspension is shown only in part for better illustration of another aspect of the invention for the guide: Whereas the guide plate 142' and the second link arm 144' are shown, the first link arm 138' has been omitted for the purpose of simplifying the illustration. On the upper edge 153 of the door panel 126, there is attached a fitting 154, on which is disposed a bearing pin or guide pin 156. The guide pin 156 engages in a corresponding bearing borehole in the guide plate 142' and connects it with the door panel in such a way that a relative horizontal movement between the door panel and the guide plate 142' is not possible. Since the movement of the guide plate 142' is established on the same degree of freedom, i.e., on the same combined rotating-sliding movement, as that of the lower support 142 and thus also that of the door panel 126, the horizontal position of the axial section 156 is clearly determined. In other words, the door is always guided synchronously at the upper and lower ends.

In fact, the connection between guide pin 156 and door panel 126 permits a relative rotating movement between the two parts; however, this is not necessary due to the synchronous rotating movement about the axis A'. It is crucial that the connection between guide pin 156 and door panel 126 also permits a relative vertical movement. The fitting having the guide pin, on the one hand, and the guide plate with bearing borehole, on the other hand, thus form axial decoupling means. The thus-constructed floating bearing permits any change whatever in distance between the upper and the lower door suspension based on a possible deformation of the housing under load of the refrigeration cabinet, which assures a low-friction and low-wear operation of the door panels without excessive reinforcement of the housing.

LIST OF REFERENCE CHARACTERS

10 Refrigeration cabinet
12 Housing
14 Access opening
16 Door
18 Interior space
20 Shelf
22 Cold curtain
24 Door panel
26 Upper door suspension
28 Lower door suspension
30 Frame
32 Bracket
34 Bracket
36 Lower radial or rotating bearing
38 Upper radial or rotating bearing
40 Lower linear guide
42 Upper linear guide
44 Drive
46 Drive motor
48 Pedestal
50 External space
52 Light source and detector unit
54 Mirror
56 Light beam
58 Presence sensor
60 Detection space of the presence sensor
62 Door panel
64 Side wall
66 Side wall
68 Boundary line of the inner pivoting region
70 Interior space
74 Linear guide
76 Guide path
78 Guide pin
82 Door panel
84 Linear guide
86 Guide pin
88 Linear guide
90 Side wall
91 Side wall
92 Door panel
94 Linear guide
96 Interior space
98 Rotating point
100 Pivoting lever
101 Articulation point
102 Circular path of the rotating point
104 Door panel
106 Linear guide
110 Disk crank
112 Push rod
114 Push rod
116 Articulation point
118 Articulation point
120 Crank pin
120 Crank pin
124 Pivoting region
126 Door panel
128 Interior space
130 Drive motor
132 Drive shaft
134 Crank
136 Push rod
138 Lever
138' First link arm
140 Housing
142 Support
142' Guide plate
144 Link rod
144' Second link arm
146 Door edge pointing to the center of the housing
148 Door edge pointing to the edge of the housing
150 External space
152 Housing
153 Upper edge
154 Fitting
156 Guide pin, bearing pin
A, AT Axis of rotation
B Width of the door panel
$D_1$, $D_1'$ Axis of rotation $D_2$, $D_2'$ Axis of rotation
$D_3$, $D_3'$ Axis of rotation
$K_1$ Arcuate curve
$K_2$ Arcuate curve
$S_1$ Edge curve
$S_2$ Edge curve
T Depth of the pedestal

What is claimed is:

1. A refrigeration cabinet, comprising:

a housing having a front access opening, a door having at least one door panel for the access opening, wherein the door panel has a height and a width, and wherein the door and the housing define an internal space, a guide that defines a movement of the door panel between a closed position and an open position in such a way that a pivoting region of the door panel projects by a distance less than the door panel width into an external space in front of the access opening, and an air-flow generator for generating a cold-air curtain in the interior region of the housing, wherein the door panel is mounted rotatably about a vertical axis and slidable crosswise to the axis of rotation, wherein the door is an automatic door with a drive for moving the door panel, and wherein the housing has a pedestal on a front side below the access opening and the door, and the pedestal projects into the external space in front of the access opening by a depth, away from the internal space, wherein the depth is greater than or equal to the distance that the pivoting region of the door panel projects.

2. The refrigeration cabinet according to claim 1, wherein the guide comprises a bearing defining the vertical axis of rotation and a guide path in a plane perpendicular to the axis of rotation, along which the bearing is mounted in a movable manner, so that the door panel is positively guided between the closed position and the open position, so that the distance the pivoting region of the door panel projects into the external space is less than the width of the door panel and a second distance the pivoting region of the door panel projects into the internal space is also less than the width of the door panel.

3. The refrigeration cabinet according to claim 2, wherein the bearing is a radial bearing or a rotating bearing.

4. The refrigeration cabinet according to claim 1, wherein the axis of rotation or a perpendicular projection of the axis of rotation onto the door panel is disposed in the direction of the width in a central region of the door panel.

5. The refrigeration cabinet according to claim 2, wherein the guide path is described by a curve, which is oriented crosswise to the axis of rotation and along which the bearing is slidably mounted.

6. The refrigeration cabinet according to claim 5, wherein the curve is an arc of a circle.

7. The refrigeration cabinet according to claim 6, wherein the axis of rotation is disposed at a rotating joint or hinge, wherein the rotating joint or hinge defines the arc of a circle.

8. The refrigeration cabinet according to claim 2, wherein the guide path is formed by a linear guide, which is oriented crosswise to the axis of rotation and along which the bearing is slidably mounted.

9. The refrigeration cabinet according to claim 8, wherein the linear guide runs parallel to the access opening.

10. The refrigeration cabinet according to claim 1, wherein the door has an opening sensor to allow for automatic opening of the door.

11. The refrigeration cabinet according to claim 10, wherein the opening sensor has a photoelectric sensor or an ultrasound sensor, which detects at least one region in the external space in front of the access opening.

12. The refrigeration cabinet according to claim 11, wherein the opening sensor is a photoelectric sensor that runs perpendicularly in front of the door panel.

13. The refrigeration cabinet according to claim 10, wherein the opening sensor has a contact sensor on the housing or on the door.

14. The refrigeration cabinet according to claim 1, further comprising a presence sensor for detecting a movement and/or a physical object in a detection space in front of the access opening.

15. The refrigeration cabinet according to claim 14, wherein the presence sensor is a motion detector.

16. The refrigeration cabinet according to claim 14, wherein the presence sensor is a photoelectric sensor.

17. The refrigeration cabinet according to claim 1, further comprising a clamping guard for detecting a physical object in the pivoting region of the door panel, the clamping guard being formed by means for monitoring the power consumption of the drive motor or by means for detecting an angular position of the drive axis.

18. The refrigeration cabinet according to claim 10, further comprising a controller combined with the opening sensor, which is set up to detect a signal from the opening sensor and when detected, to emit a control signal to the drive for opening the door.

19. The refrigeration cabinet according to claim 18, wherein the controller is set up to emit a control signal to the drive for closing the door after a selectable time period has passed after the door has been opened.

20. The refrigeration cabinet according to claim 18, wherein the controller is set up to detect a signal from a presence sensor, and when detected, to emit a control signal to the drive for keeping the door open, or, if the door has just closed, for opening the door.

21. The refrigeration cabinet according to claim 1, wherein the air-flow generator generates the cold-air curtain in the interior region of the housing directly behind the access opening.

22. The refrigeration cabinet according to claim 1, further comprising a plurality of double-panel doors forming an un-interrupted, transparent front.

23. The refrigeration cabinet according to claim 22, wherein shelves are disposed in an interior space of the housing, the shelves being configured consistently and with straight front edges over the plurality of double panel doors.

24. A refrigeration cabinet, comprising:

a housing having a front access opening, a plurality of double-panel doors forming an un-interrupted, transparent front, wherein the door panels each have a height and a width, and wherein the plurality of double-panel doors and the housing define an internal space, a guide that defines a movement of each door panel between a closed position and an open position in such a way that a pivoting region of each door panel projects by a distance less than the door panel width into an external space in front of the access opening, and an air-flow generator for generating a cold-air curtain in the interior region of the housing, wherein the door panel is mounted rotatably about a vertical axis and slidable crosswise to the axis of rotation, wherein the door is an automatic door with a drive for moving the door panel, and wherein the housing has a pedestal on a front side below the access opening and the doors, and the pedestal projects into the external space in front of the access opening by a depth, away from the internal space, wherein the depth is greater than or equal to the distance that the pivoting region of the door panel projects.

25. A cabinet, comprising:

a housing having a front access opening, a door having at least one door panel for the access opening, wherein the door panel has a height and a width, and wherein the door and the housing define an internal space, a guide that defines a movement of the door panel between a closed position and an open position in such a way that a pivoting region of the door panel projects by a distance less than the door panel width into an external space in front of the access opening, and wherein the door panel is mounted rotatably about a vertical axis and slidable crosswise to the axis of rotation, wherein the door is an automatic door with a drive for moving the door panel, and wherein the housing has a pedestal on a front side below the access opening and the door, and the pedestal projects into the external space in front of the access opening by a depth, away from the internal space, wherein the depth is greater than or equal to the distance that the pivoting region of the door panel projects.

* * * * *